US012440736B2

(12) United States Patent
Garcia

(10) Patent No.: US 12,440,736 B2
(45) Date of Patent: Oct. 14, 2025

(54) GOLF CLEAT WITH INTEGRATED BRISTLES

(71) Applicant: Andres F. Garcia, Lutz, FL (US)

(72) Inventor: Andres F. Garcia, Lutz, FL (US)

( * ) Notice: Subject to any disclaimer, the term of this patent is extended or adjusted under 35 U.S.C. 154(b) by 0 days.

(21) Appl. No.: 18/486,537

(22) Filed: Oct. 13, 2023

(65) Prior Publication Data

US 2024/0123304 A1 Apr. 18, 2024

Related U.S. Application Data

(60) Provisional application No. 63/379,373, filed on Oct. 13, 2022.

(51) Int. Cl.

| | |
|---|---|
| ***A63B 57/60*** | (2015.01) |
| ***A43B 5/00*** | (2022.01) |
| ***A43C 13/04*** | (2006.01) |
| ***A43C 15/16*** | (2006.01) |

(52) U.S. Cl.

CPC ..... *A63B 57/60* (2015.10); *A43B 5/001* (2013.01); *A43C 13/04* (2013.01); *A43C 15/162* (2013.01)

(58) Field of Classification Search

CPC ..... A43B 5/001; A43C 13/04; A43C 15/16; A43C 15/162; A43C 15/164; A43C 15/165; A43C 15/167; A43C 15/168; A43C 19/00; A46B 2200/3073; A47L 23/22; A63B 57/60

See application file for complete search history.

(56) References Cited

U.S. PATENT DOCUMENTS

| | | | | |
|---|---|---|---|---|
| 4,122,577 | A | 10/1978 | Catania | |
| 4,356,643 | A * | 11/1982 | Kester | A43B 13/22 36/59 C |
| 5,173,985 | A * | 12/1992 | Palmer | A47L 13/282 451/523 |
| 5,375,287 | A * | 12/1994 | Dillahunt | A46B 9/02 15/160 |
| 5,809,669 | A | 9/1998 | Hage et al. | |
| D411,240 | S * | 6/1999 | Risko | D4/130 |
| 5,930,920 | A | 8/1999 | Arnold | |
| 5,979,008 | A | 11/1999 | Gordon | |
| 6,009,640 | A | 1/2000 | Deacon et al. | |
| 6,041,526 | A * | 3/2000 | Collins | A43C 15/164 36/134 |
| 6,092,313 | A * | 7/2000 | Dunlap | A43B 3/00 36/132 |
| 6,255,235 | B1 * | 7/2001 | Hiraoka | B29C 66/8322 2/161.3 |
| 6,393,648 | B1 | 5/2002 | Reynolds | |

(Continued)

*Primary Examiner* — F Griffin Hall

(74) *Attorney, Agent, or Firm* — Tarolli, Sundheim, Covell &Tummino LLP

(57) ABSTRACT

The present disclosure is related to a cleat for a shoe. The cleat can include a base having opposing first and second surfaces. The cleat further includes a fastener extending from the first surface and adapted to couple the cleat to a sole of the shoe. Additionally, the cleat can include a plurality of spike legs arranged in a distributed arrangement and extending outwardly from the second surface of the base to terminate in a distal end portion spaced from the second surface. The cleat can further include bristles extending between at least some adjacent pairs of the spike legs away from the second surface of the base.

15 Claims, 17 Drawing Sheets

(56) References Cited

U.S. PATENT DOCUMENTS 6,732,397 B2 5/2004 Thompson
7,287,343 B2 * 10/2007 Healy ..... A43B 13/223 D2/908
7,437,793 B2 10/2008 Lane
7,832,120 B2 * 11/2010 Jung ..... A43B 13/223 36/59 C
7,866,064 B2 * 1/2011 Gerber ..... A43B 13/36 36/62
8,032,969 B1 * 10/2011 Connelly ..... A43B 5/001 15/210.1
8,375,501 B1 * 2/2013 Courcy ..... A63B 57/60 15/210.1
8,413,352 B2 4/2013 Watkins
8,458,847 B2 * 6/2013 Herrmann ..... A43B 5/001 15/176.1
9,723,914 B2 * 8/2017 Connelly ..... A46B 5/04
10,022,033 B1 * 7/2018 Maynard ..... A46B 15/0055
10,306,945 B2 * 6/2019 Koo ..... B29C 43/305
10,576,341 B2 * 3/2020 Engel ..... A63B 57/60
11,229,282 B1 * 1/2022 Shafer ..... A43B 13/04
12,102,174 B2 * 10/2024 McLachlan ..... A43B 5/025
2002/0184791 A1 * 12/2002 Ko ..... A43B 7/146 36/141
2003/0131500 A1 * 7/2003 Kline ..... A63B 57/60 36/127
2003/0208869 A1 * 11/2003 Thompson ..... A63B 57/60 15/210.1
2003/0208932 A1 11/2003 Thompson
2006/0265828 A1 * 11/2006 Mallatt ..... A47L 13/282 401/6
2006/0282967 A1 * 12/2006 Williams ..... A63B 57/60 15/160
2007/0240330 A1 * 10/2007 Beasley ..... A43D 999/00 36/7.7
2009/0119857 A1 * 5/2009 Yurman ..... A63B 57/60 15/210.1
2009/0293215 A1 * 12/2009 Zhou ..... A43B 5/001 15/210.1
2011/0030159 A1 * 2/2011 Mullis ..... A63B 57/60 15/160
2014/0338142 A1 * 11/2014 Pierce ..... A43B 5/001 15/246
2015/0209634 A1 * 7/2015 McMahon ..... A43C 19/00 15/160

* cited by examiner

GOLF CLEAT WITH INTEGRATED BRISTLES

CROSS-REFERENCE TO RELATED APPLICATION

This application claims the benefit of priority to U.S. Provisional Patent App. No. 63/379,373, filed on Oct. 13, 2022, which is incorporated herein by reference in its entirety.

TECHNICAL FIELD

This disclosure relates to golf cleats with integrated bristles and to methods for cleaning golf clubs.

BACKGROUND

Cleats or studs are protrusions on the sole of a shoe or on an external attachment to a shoe that provide additional traction on a soft or slippery surface. They can be conical or blade-like in shape and can be made of plastic, rubber or metal. The type worn depends on the environment of play: grass, ice, artificial turf, or other grounds. Spiked or cleated shoes are worn by many golfers. Initially, metal spikes were used. Metal spikes have been outlawed by many golf courses which now require soft spikes. Soft spikes are generally made of thermoplastic materials.

SUMMARY

This disclosure relates to golf cleats with integrated bristles and to methods for cleaning golf clubs.

As an example, a system includes a cleat for a shoe. The cleat can include a base having opposing first and second surfaces. The cleat can further include a fastener extending from the first surface and adapted to couple the cleat to a sole of the shoe. Furthermore, the cleat can include a plurality of spike legs arranged in a distributed arrangement and extending outwardly from the second surface of the base to terminate in a distal end portion spaced from the second surface. Moreover, the cleat can include bristles extending between at least some adjacent pairs of the spike legs away from the second surface of the base.

As another example, a system includes a cleat for a shoe, the cleat comprising a base having opposing first and second surfaces. The cleat can include a fastener extending from the first surface and adapted to couple the cleat to a sole of a shoe. Furthermore, the cleat can include a plurality of spike legs extending radially outwardly from the second surface of the base. Additionally, the cleat can include a plurality of bristles extending radially outwardly from the second surface of the base at locations between adjacent pairs of the spike legs.

As another example, a method for cleaning a head of a golf club. The method can include urging the head of the golf club to contact at least one cleat carried on a bottom of a shoe. A plurality of spike legs and multiple sets of bristles form part of and extend from a contact surface of the at least one cleat. Additionally, the method can include moving the head of the golf club relative to the at least one cleat while the contact between the head and the at least one cleat is maintained so at least some of the bristles rub against the head of the club to remove debris from the head of the club.

DETAILED DESCRIPTION

Figure 1A:
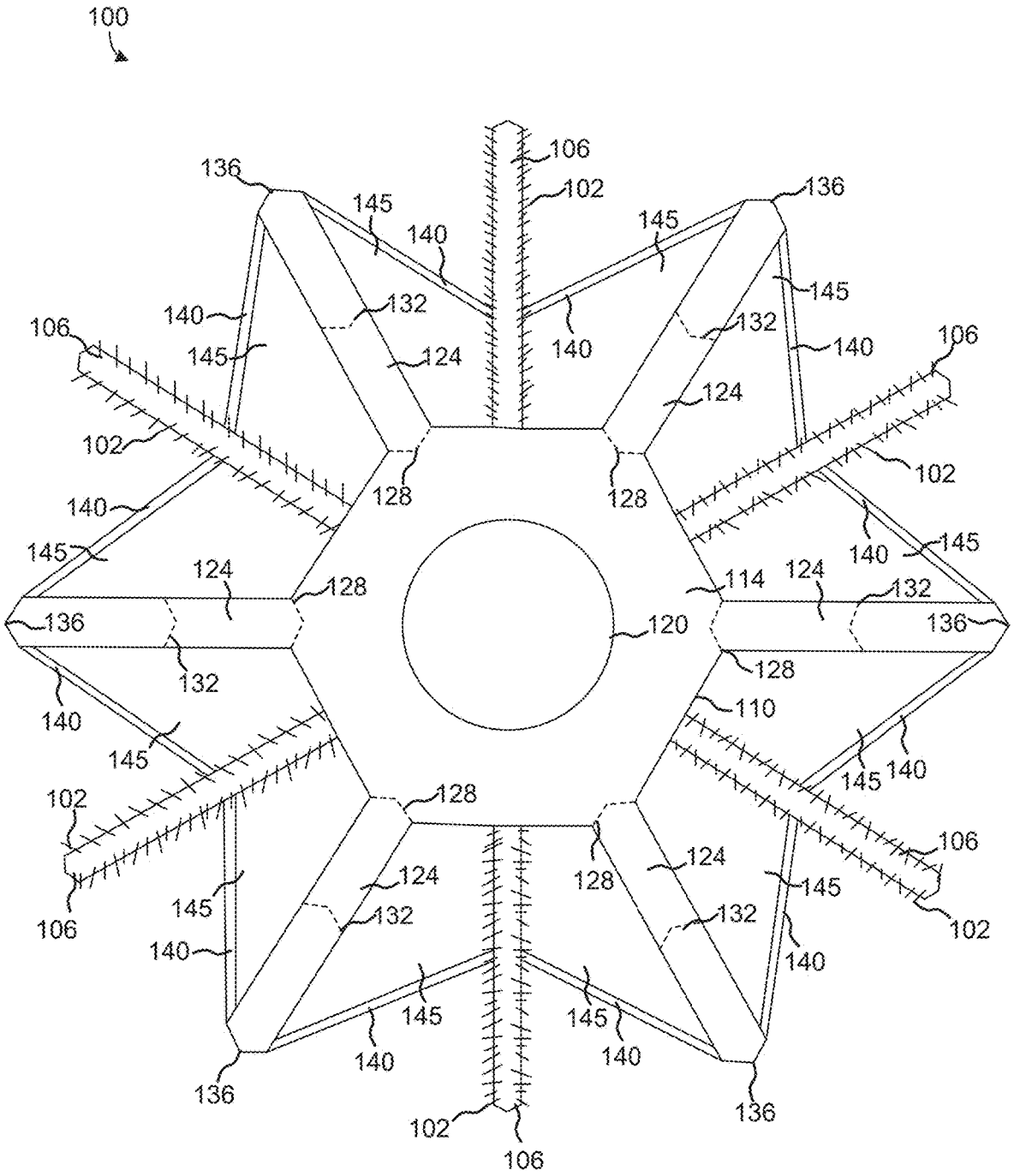
FIG. 1A illustrates a top view of an example cleat with integrated bristles.

This disclosure relates to golf cleats with integrated bristles and to methods for cleaning golf clubs. The cleat can include a base with opposing first and second surfaces. The first surface of the base can include a fastener configured for attaching the cleat to a shoe. Further, the cleat can have a plurality of spike legs that extend radially outward from the second surface of the base. For example, a proximal end of the plurality of spike legs can be attached to the second surface of the base, such that a medial portion of the plurality of spike legs extends radially outward from the second surface of the base. Accordingly, a distal end of the plurality of spike legs can extend from the medial portion of the plurality of spike legs in a direction away from the base to facilitate gripping a walking surface when coupled to a shoe.

The cleat also includes a plurality of bristles. The bristles can be formed of one or more flexible materials, such as a plastic and/or metal. The bristles can be arranged on the cleat and adapted (e.g., having a length, width and/or stiffness) to facilitate cleaning the face of a golf club, including grooves formed therein. In an example, the bristles extend from an arrangement of spike legs and/or from a central base portion of the cleat. In another example, the bristles extend outwardly from a plurality of bristle legs that are alternately arranged with the plurality of spike legs, such that one or more bristle legs are located between adjacent spike legs. The plurality of bristles legs can also extend radially outward from the base. Also, or as an alternative, the bristle legs can be omitted and an arrangement of bristles can extend outwardly from the base.

In a further example, the cleat can also include one or more biased members, such as a plurality of levers (also referred to as biased arms or support webs). For example, each of the plurality of levers can extend between a distal end of a spike and to a medial portion of an adjacent bristle. Accordingly, biased member(s) can couple the plurality of bristle legs with the plurality of spike legs such that axial movement of the spike legs results in corresponding axial movement of the bristles. For example, the biased member can form a web on a distal side or between bristles and the plurality of spike legs that extends circumferentially around the central base of the cleat. As a result, movement of the adjacent spike leg (e.g., toward the base) causes the given bristles to move in the same direction. In example, the spike legs and bristles are attached (e.g., directly or indirectly) to a central web of an elastic material so that movement of the spike legs, such as in response to contact with the ground (e.g., during walking), urges the bristles away from the ground. In another example, a given bristle leg of the plurality of bristle legs is movable at about an axis (or pivot location) where the proximal end of the given bristle leg attaches to the base, and the lever is configured to move the distal end of the bristle leg a greater axial distance than the spike leg is moved. Thus, the spike legs provide their normal function to increase traction and grip the ground while the bristles are moved away from the ground, such as might move into contact with the sole of the shoe.

In an example, the plurality of spike legs of the cleat can be an elastically deformable (e.g., compliant) material (e.g., a polymer), such that a given spike leg of the plurality of spike legs is movable along a length of the given spike leg and returns back to its original position. For example, a given spike leg of the plurality of spike legs can have an elongate portion(s) that extends radially outward from the base in the direction of the given spike leg. The plurality bristles of the cleat can be a stiff but flexible material, which can be the same or a different material from the spike legs. The spike legs and bristles can be formed of one or more materials depending on the cleat configuration.

As described herein, the cleat can be a golf cleat that can be attached to the bottom of a shoe via a fastener, which can vary depending on the type and of the cleat. There are numerous types of cleats having various different types of fasteners, and the cleat described herein can be implemented in any such cleat without distinction. During use, the plurality of bristles are at least sufficiently exposed, such that the bristles can be used to clean the face of the golf club.

FIG. 1A illustrates a top view of an example cleat 100 that includes integrated bristles 102. The cleat 100 can include a base 110 that has a first surface 114 and a second surface, the second surface being opposite the first surface 114. The first surface 114 can further include a fastener 120, the fastener 120 being centrally located on the base 110. Additionally, or alternatively, the fastener 120 can extend through the base 110 from the first surface 114 to the second surface. The fastener 120 can be configured to fasten the cleat 100 to a corresponding cleat insert receptacle or otherwise secure the cleat to a bottom surface of a shoe. The configuration of the fastener 120 can vary according to a type of cleat insert system. For example, the fastener 120 can be a threaded fastener (e.g., metal or plastic threads), pins, twist-lock fasteners or other type of insert system.

In one example, the bristles 102 are attached to and extend from a bristle legs 106. In other examples, the bristles 102 can extend from other parts of the cleat, such as from the base 120 or spike legs 124. The plurality of bristle legs 106 can extend radially outward from the base 110, such that a proximal end of the plurality of bristle legs can be coupled to the base 110. For example, the plurality of bristle legs 106 can be coupled to the second surface of the base 110. Additionally, or alternatively, a proximal end of the plurality of bristle legs 106 can be coupled between the fastener 120 and the first surface 114 and/or or second surface of the base 110. In an additional or alternative example, the plurality of bristle legs 106 can be extensions of the base 110, such that the bristle legs 106 are integrated with the base 110.

The cleat 100 can further include a plurality of spike legs 124 that extend radially outward from the second surface of the base 110. A given cleat 100 can include any number of spike legs 124, such as two, three, four, five, six or more (e.g., six spike legs in FIG. 1). The plurality of spike legs 124 can be extensions of the base 110, such that the plurality of spike legs 124 are integrated with the base 110. Additionally, or alternatively, the plurality of spike legs 124 can be coupled to a second surface 150 of the base (e.g., extending axially away from the base 110). In an additional or alternative example, the bristles 102 are attached to and extend from the spike 124. The configuration and arrangement of spike legs can vary depending on the type and style of cleat. The bristles 102 and/or bristle legs 106 described herein can be implemented in a cleat regardless of the type or configuration of spike legs 124. In an example, the plurality of bristle legs 106 can be alternately arranged with the plurality of spike legs 124, such that each bristle 102 of the plurality of bristle legs 106 is located between an adjacent pair of spike legs 124.

Each of the plurality of spike legs 124 has a proximal end 128, a medial portion 132, and a distal end 136, the proximal end 128 being most proximal to the base 110 of the cleat 100 and the distal end 136 opposite the proximal end 128. Likewise, each spike 124 can be located between an adjacent pair of bristle legs 106. In some examples, the cleat 100 can further include a plurality of levers 140. Each lever 140 of the plurality of levers 140 can extend between a given bristle leg 106 and adjacent spike 124. For example, a first end of a given lever 140 is coupled to an end portion of a bristle leg 106 and the second end of the given lever 140 is coupled to a medial portion of the adjacent spike 124. Also, or as an alternatively, the spike legs 124 can be configured to also implement the lever function described herein and the separate levers 140 can be omitted.

The plurality of levers 140 can form a web between the plurality of bristle legs 106 and the plurality of spike legs 124, such as shown in FIG. 1. The plurality of levers 140 can be formed from a rigid material, which can be the same material as the bristle legs 106 and/or spike legs. Alternatively, the plurality of levers 140 can be formed from another type of material. Furthermore, the levers 140 that extend between the spike legs 124 and bristle legs 106 form an opening 145 between the levers 140, spike legs 124, bristle legs 106, and base 110. The openings are at least viewable from the top view of FIG. 1. In response to applying sufficient force to move the spike legs 124 in a direction towards the second surface of the base 110 (e.g., a direction coming out of and orthogonal to a virtual plane in which drawing sheet resides), the levers 140 are configured to transfer at least a portion of the force to cause corresponding axial movement of the adjacent bristle legs 106 (see, e.g., FIG. 3).

Figure 1B:
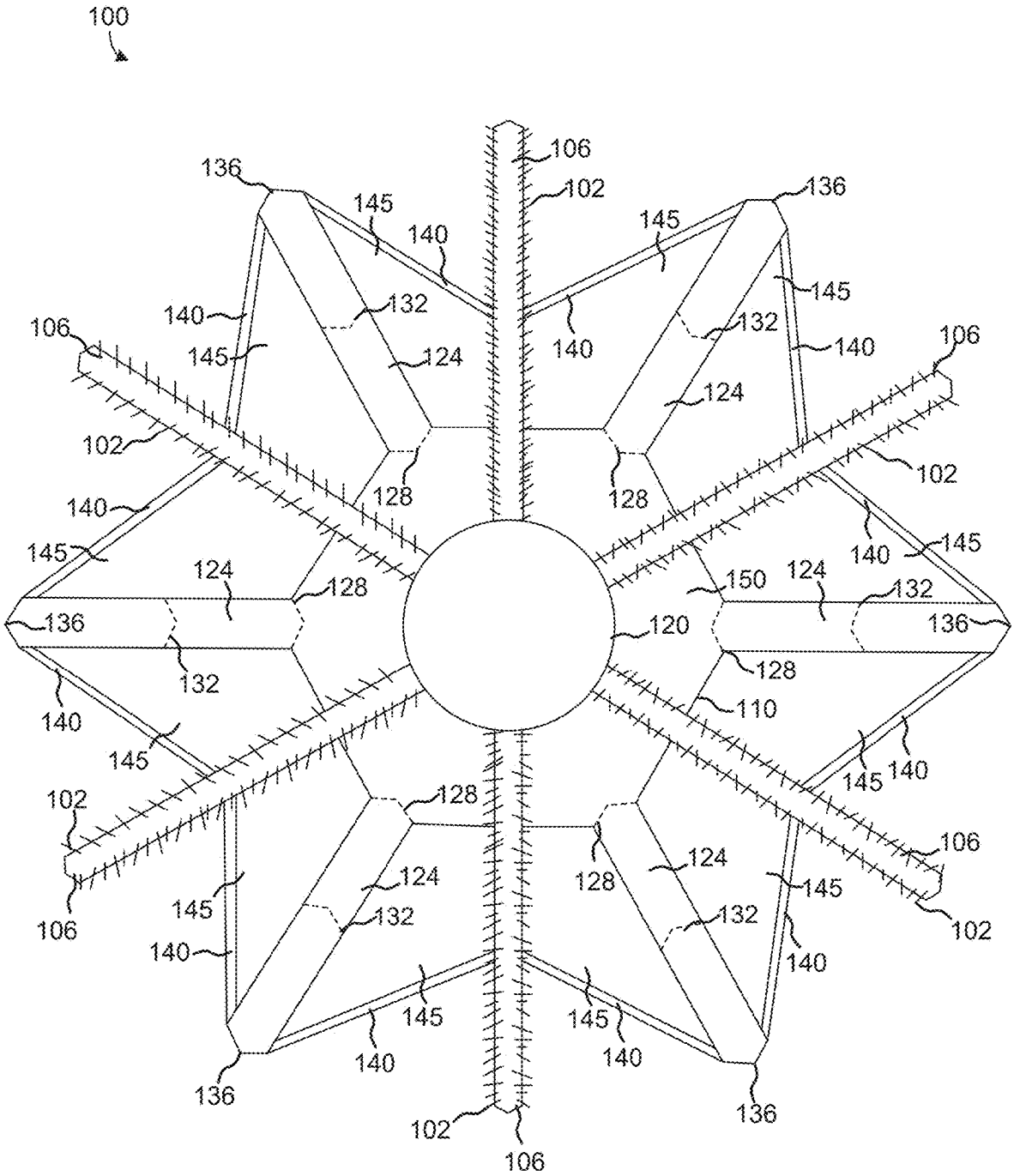
FIG. 1B illustrates a bottom view of the example cleat with integrated bristles of FIG. 1A.

FIG. 1B illustrates a bottom view of the cleat 100 with integrated bristles 102. From the bottom view, the second surface 150 of the base 110 is viewable. Centrally located on the second surface of the base 110 can be another side of the fastener 120. In some examples, the central point at which the fastener 120 is located on the second surface 150 can be a point or region that the plurality of bristle legs 106 are adapted to couple.

Figure 2A:
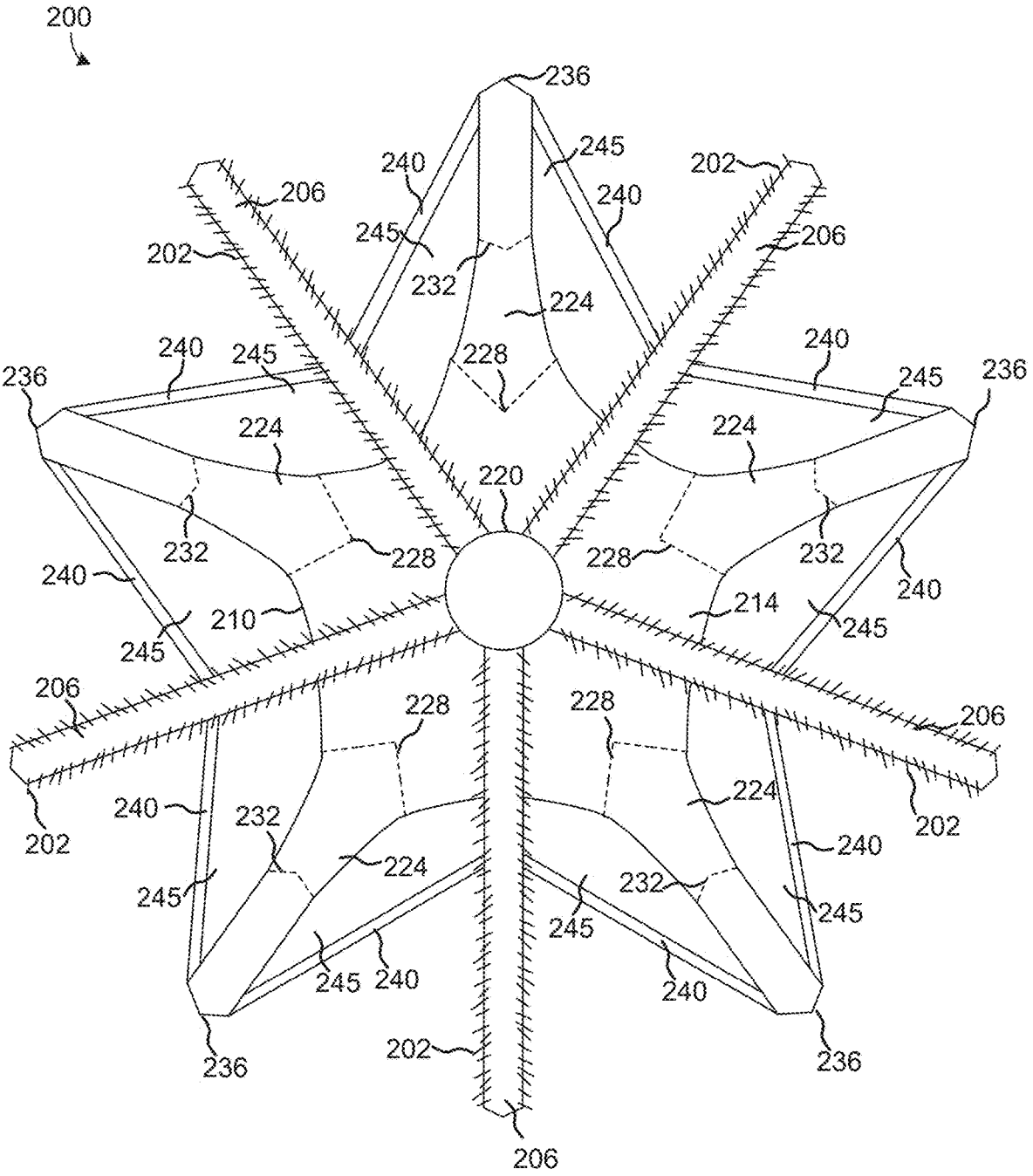
FIG. 2A illustrates a top view of another example cleat with integrated bristles.

FIG. 2A illustrates a bottom view of another example cleat 200 integrated with a bristles 202. In an example, the bristles 202 can be formed to the bristle legs 206, such that the bristles 202 extend from the bristle legs 206. The cleat 200 can further include a base 210 that has a first surface (not illustrated) and a second surface 214 that opposes the first surface. The plurality of bristle legs 206 can extend radially outward from the second surface 214 of the base 210. In an example, a proximal end of the plurality of bristle legs 206 is coupled to the base 210, such as to extend from first and/or second surfaces of the base 210. In an alternative example, the proximal end of the plurality of bristle legs 206 can couple to a fastener 220 or a central portion of the second surface 214 of the base 210. The fastener 220 can be accessible from a central portion of the second surface 214 of the base 210, such as for coupling the cleat to a shoe as described herein.

The cleat 200 can further include a plurality of spike legs 224 that extend radially outward from the base 210. Each of the plurality of spike legs 224 has a proximal end 228, a medial portion 232, and a distal end 236, the proximal end 228 being most proximal to the base of the cleat 200 and the distal end 236 opposite the proximal end 228. In an example, the spikes 224 can be integrated with the base 210. In another example, the proximal end 228 of the spike legs 224 can be coupled to the second surface 214 of the base 210. The plurality of bristle legs 206 can be arranged alternatingly with the plurality of spike legs 224, such that each bristle leg 206 is located between an adjacent pair of spike legs 224. In other examples, more than one spike 224 could be located between adjacent pairs of bristle legs 206 or more than one bristle leg 206 could be located between adjacent pairs of spike legs.

Each spike has a distal end portion 236 that can be configured to move (e.g., bend or pivot) relative to base 210. For example, the distal end 236 of the given spike leg 224 can move about an axis of rotation that is parallel to the second surface 214 of the base 210 and is perpendicular to the length of the given spike leg 224 at the proximal end 128. The spike leg can be configured so its axis of rotation corresponds to the proximal end 228 and/or medial portion 232 of the spike leg 224.

The cleat 200 can further include a plurality of levers 240. Each lever 240 can extend between a given bristle leg 206 and an adjacent spike 224. For example, one end of a given lever 240 can be coupled to a medial portion of a bristle leg 206 and the other end of the given lever 240 can be coupled to the distal end 236 of an adjacent spike 224. The bristle legs 206, base 210, spike legs 224, and levers 240 can form openings 245 between the bristle legs 206, base 210, spike legs 224, and levers 240. Additionally, the bristles 202, bristle legs 206, base 210, spike legs 224, and levers 240 can be of the same material and construction as the bristles 102, bristle legs 106, base 110, spike legs 124, and levers 140 of FIG. 1.

Because an associated lever 240 can operatively connect the distal end 236 of the given spike leg to a medial portion of an adjacent bristle leg 206, movement of the distal end 236 of the given spike leg 224, such as during changes between periods of contact and non-contact with the ground (e.g., during walking) causes corresponding movement of the adjacent bristle leg(s) 206. That is, similar to the cleat 100 of FIG. 1, in response to applying sufficient force to move the spike 224 in a direction towards the second surface of the base 210 (e.g., a direction coming out of and orthogonal to a virtual plane in which drawing sheet resides), the levers 240 are configured to transfer at least a portion of the force to cause corresponding axial movement of the adjacent bristle legs (see, e.g., FIG. 3) in the same direction.

Figure 2B:
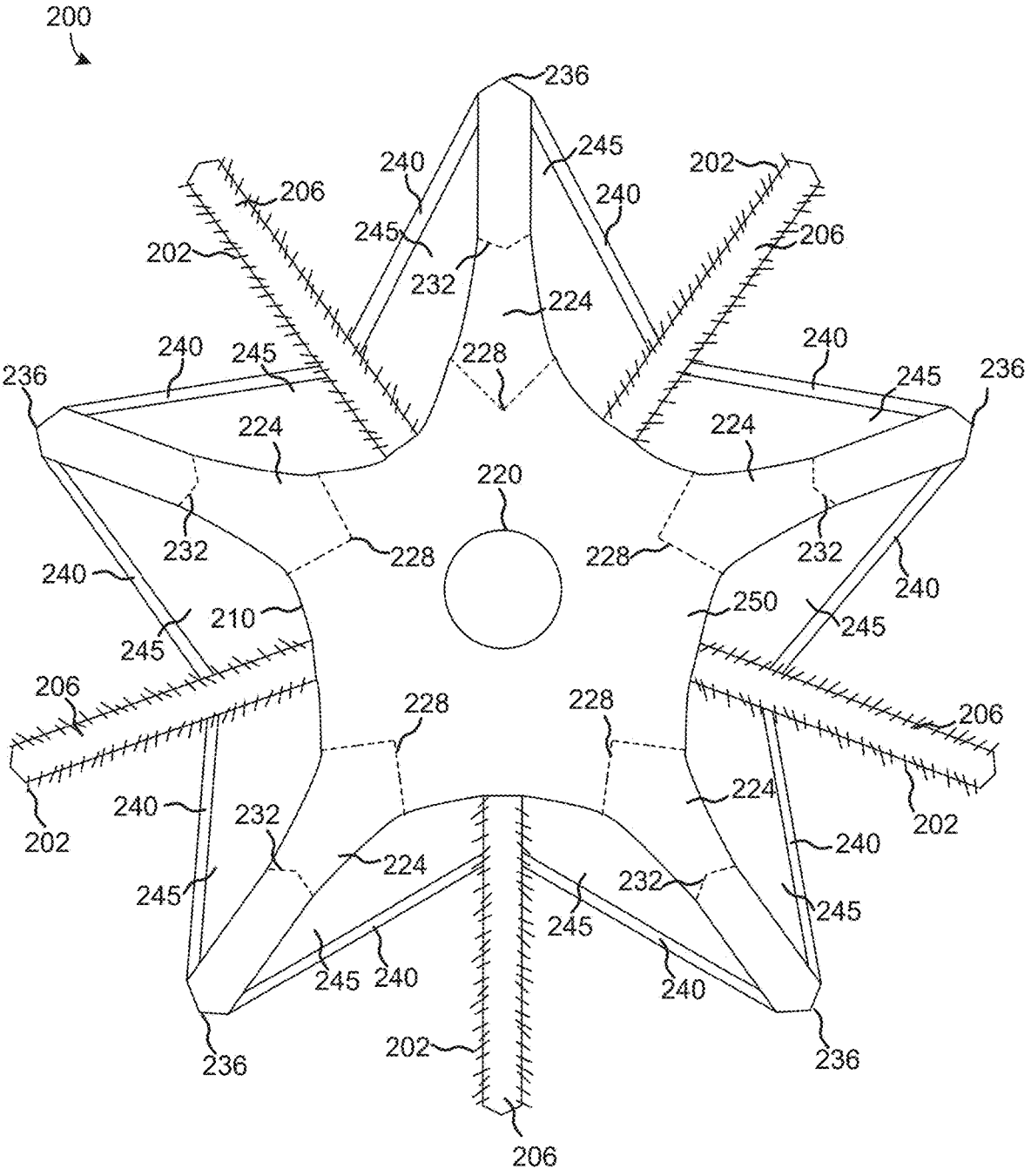
FIG. 2B illustrates a bottom view of the example cleat with integrated bristles of FIG. 2A.

FIG. 2B illustrates a top view of the cleat 200 with integrated bristles 202. From the top view, a second surface 250 of the base 110 is viewable. Centrally located on the second surface of the base 210 can be the fastener 220.

Figure 3:
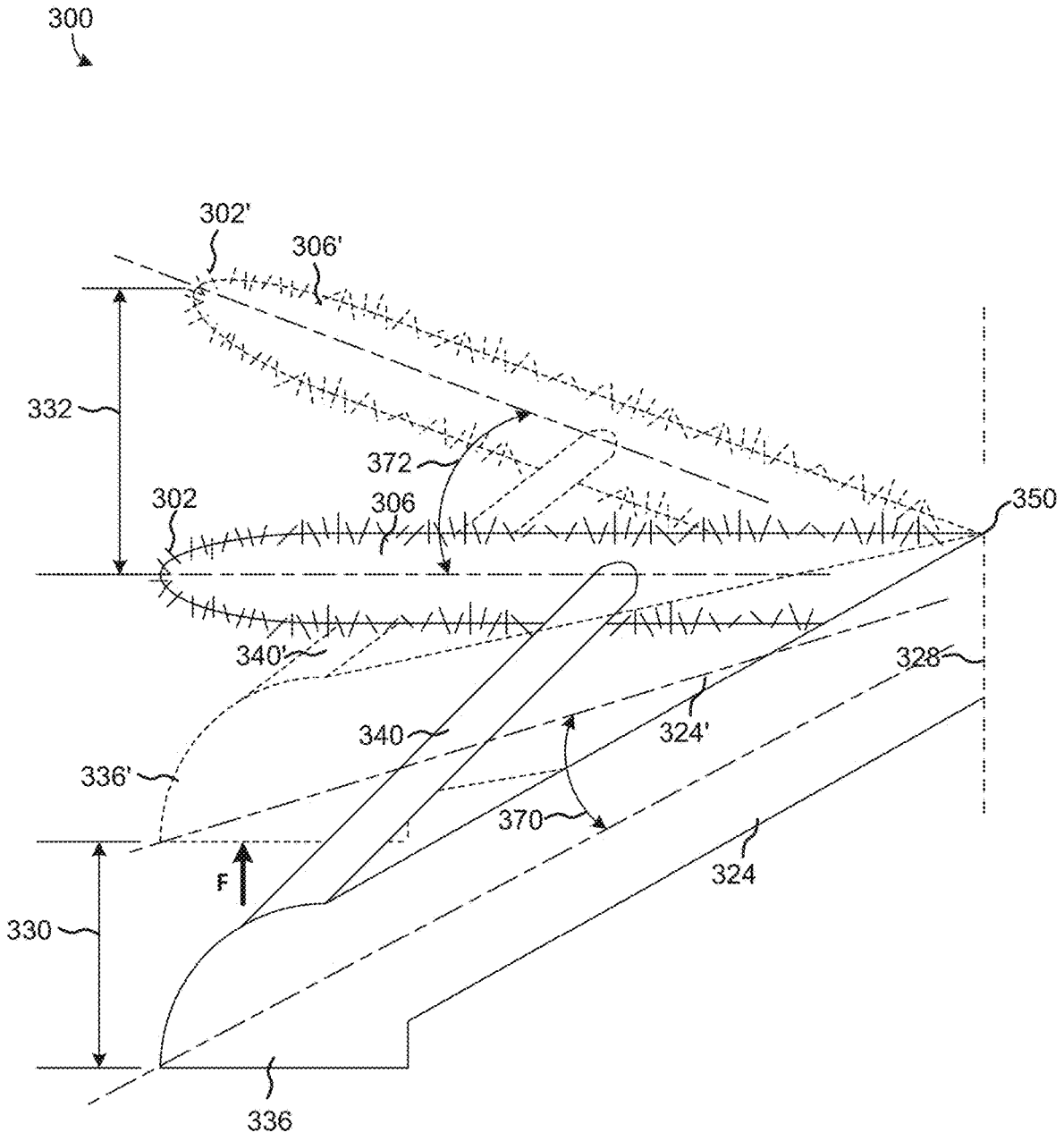
FIG. 3 illustrates a cross-sectional view of a cleat with integrated bristles in a first state and a second state.

FIG. 3 illustrates a cross-sectional view of part of an example cleat 300 having integrated bristles 302 in a respective first and second state. The description of FIG. 3 is applicable to the example cleats 100 and 200 as well as other cleats described herein. The cleat 300 includes a bristle leg 306 and an adjacent spike leg 324. A proximal end 328 of the spike leg and a proximal end of the bristle leg 306 can be coupled to a base, such as base 110 of FIG. 1. A distal end 336 of the spike leg can be coupled to a medial portion of the bristle leg 306 via a lever 340. As described herein, a lever 340 extends between the distal end 336 of the spike leg 324 and a medial portion of the bristle leg 306. The bristle leg 306 is configured to rotate (or pivot) about an axis of rotation 350, such as corresponding to a point of attachment between the proximal end of the bristle leg 306 and the base. For purposes of simplification, the proximal end 328 of the spike 324 is illustrated in the same location as the proximal end of the bristle leg 306, such that the spike 325 has the same axis of rotation 350 as the bristle leg 306. In other examples, the axes of rotation for the spikes and bristle legs can be at different positions, such as described herein.

As illustrated in FIG. 3, the example cleat 300 is in a first state (e.g., its normal, unperturbed position), such as when no force is being applied to the spike leg 324. The spike leg 324 has an angle of rotation 370 about the axis of rotation 350 when the cleat is in the first state. In the first state, the bristle leg 306 has an angle of rotation 360 about its axis of rotation (e.g., also representative of its normal, unperturbed position).

As described herein, the spikes 325, levers 340 and bristle legs 306 are flexible so as to be moveable. Thus, the example cleat 300 can be in a second state, such as can correspond to when force is applied to the spike leg 324', as shown by arrow F. In the example of FIG. 3, the cleat 300 is illustrated in its second state using dashed lines and by designating parts of the cleat by a prime symbol (').  Accordingly, the spike leg 324' of the second state is in a location different than the location of the spike leg 324 in the first state. As shown, the spike leg 324' is movable over an angle of rotation, shown at 370, between the first and second states. In response to applying positive force F to the distal end 336' of the spike leg 324' in the direction shown along the y-axis, the spike leg 324' is in the second state and thus rotated the angle 370. This also results in the distal end 336' moving a distance along the y-axis, shown at 330. Thus, the spike leg 324' in the second state is closer to the base than the spike leg 324 in the first state. The distance 330 that the spike leg 324 moves can depend on the force F that is applied as well as be constrained by the base of the cleat and/or the soul of a shoe to which it is attached.

Because a respective lever 340 couples the medial portion of the bristle leg 306 to the distal end 336 of the spike leg 324, the bristle leg 306 is configured to move responsive to movement of the spike leg 324. That is, the bristle leg 306 is movable between respective first and second states. For example, responsive to the force F applied to the spike leg 324' to place the cleat is in its second state, the lever 340 transfers at least a portion of the applied force to move the bristle leg 306' to its second state position. In the second state, the bristle leg 306' moves an angle of rotation, shown at 372, relative to the first state (e.g., normal position) of the bristle leg 306. Responsive to the bristle leg 306 rotating the angle 372, a distal end of the bristle leg also moves a distance along the y-axis, shown at 332. Thus, distal end of the bristle leg 306' in the second state is closer to the base (and sole of the shoe) than the bristle leg 306 in the first state. The distance 332 that the bristle leg 306 moves can depend on the force F that is applied, the configuration and stiffness of the lever arm 340, as well as be constrained by the base of the cleat and/or the soul of a shoe to which it is attached. The distance 332 can be greater than 330, such as for the configuration shown in FIG. 3, where level transfer movement of the distal end of the spike leg 324 to a medial part of the bristle leg 306. In other examples, the distances 330 and 332 traversed and angles of rotation 370 and 372 for each of the legs can be the same or differ by other amounts depending on the configuration of the respective legs 306 and 324 and the configuration of the lever arm 340.

Figure 4:
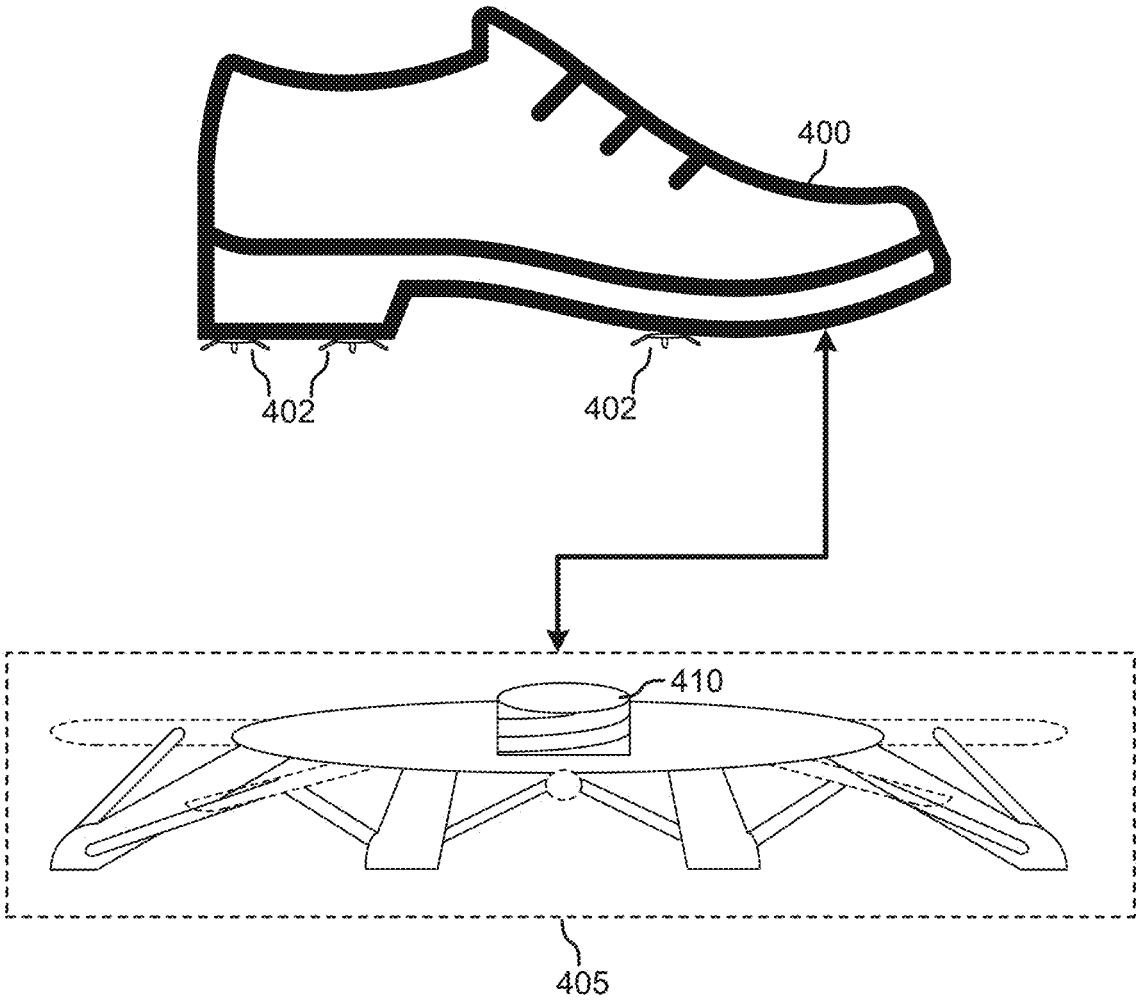
FIGS. 4-6 illustrate examples of shoes including cleats with integrated bristles.

FIG. 4 illustrates an example of a shoe 400 including a plurality of cleats 402, at least one of which is a cleat with integrated bristles 405, such as disclosed herein (e.g., FIGS. 1-3). The shoe 400 can have a plurality of connectors or receptacles located across the sole of the shoe 400. In an example, the connectors located across the sole of the shoe 400 can be a female connector part, such that the connectors are adapted to couple to a corresponding male fastener 410 of the cleat with integrated bristles 405. Alternatively, each of the connectors located across the sole of the shoe 400 can be a male connector adapted to couple to a female fastener. In other examples, the cleat with integrated bristles 405 can include a fastener 410 configured (e.g., as a screw thread) to attach directly to the sole of the shoe 400. A plurality of cleats 402 can be coupled to the sole of the shoe 400 by coupling fasteners of respective cleats 402 to the respective connectors located across the sole of the shoe 400. The manner of coupling between the cleats 402 and shoe can vary according to the type of fasteners, such as described herein.

Figure 5:
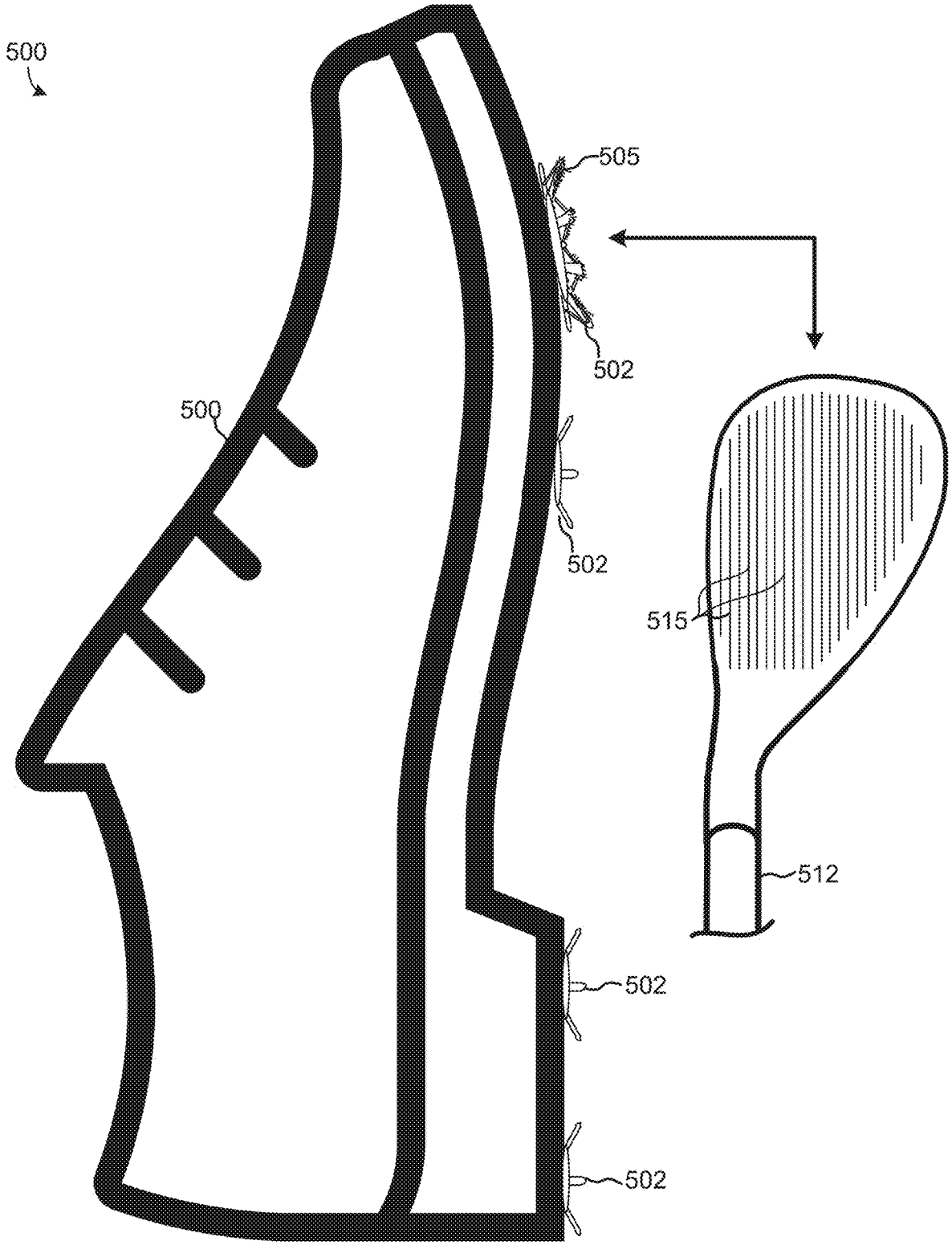

FIG. 5 illustrates an example use of a shoe 500 (e.g., FIG. 4) including a plurality of cleats 502, at least one of which is a cleat with integrated bristles 505, such as disclosed herein (e.g., FIGS. 1-4). The cleat with integrated bristles 505 can be urged toward a face of a golf club 512. The face of the golf club 512 can have a plurality of club grooves 515. The plurality of grooves 515 are cut into the face of the golf club 512 to improve performance of the respective golf club and can be further designed to adjust flight of a golf ball upon impact with the face of the golf club 512. However, the plurality of grooves 515 can become filled with dirt and debris over time and in response to being used to play golf. Accordingly, the dirt and debris can negatively impact the flight of a golf ball upon impact with the face of the golf club 512 and decrease performance of the respective golf club. The cleat integrated with bristles 505 can be urged toward and applied to the face the golf club 512, such that the bristle legs of the cleat integrated with bristles 505 remove dirt and debris from the plurality of grooves 515 of the face of the golf club 512.

In some examples, the cleat with integrated bristles 505 can be in a first state (e.g., example cleat 300 of FIG. 3). That is, the cleat with integrated bristles 505 is in a first state (e.g., FIG. 3), such that no pressure is being applied to the cleat with integrated bristles 505. Because the cleat with integrated bristles 505 is in a first state, the bristle legs of the cleat can extend radially outwardly and axially from a base (e.g., 110 of FIG. 1) in a manner that exposes the bristle legs. Furthermore, the cleat with integrated bristles 505 can be urged toward the face of the golf club 512 such that bristle legs contact the face of the golf club 512 and the plurality of grooves 515 substantially more than its spikes.

Figure 6:
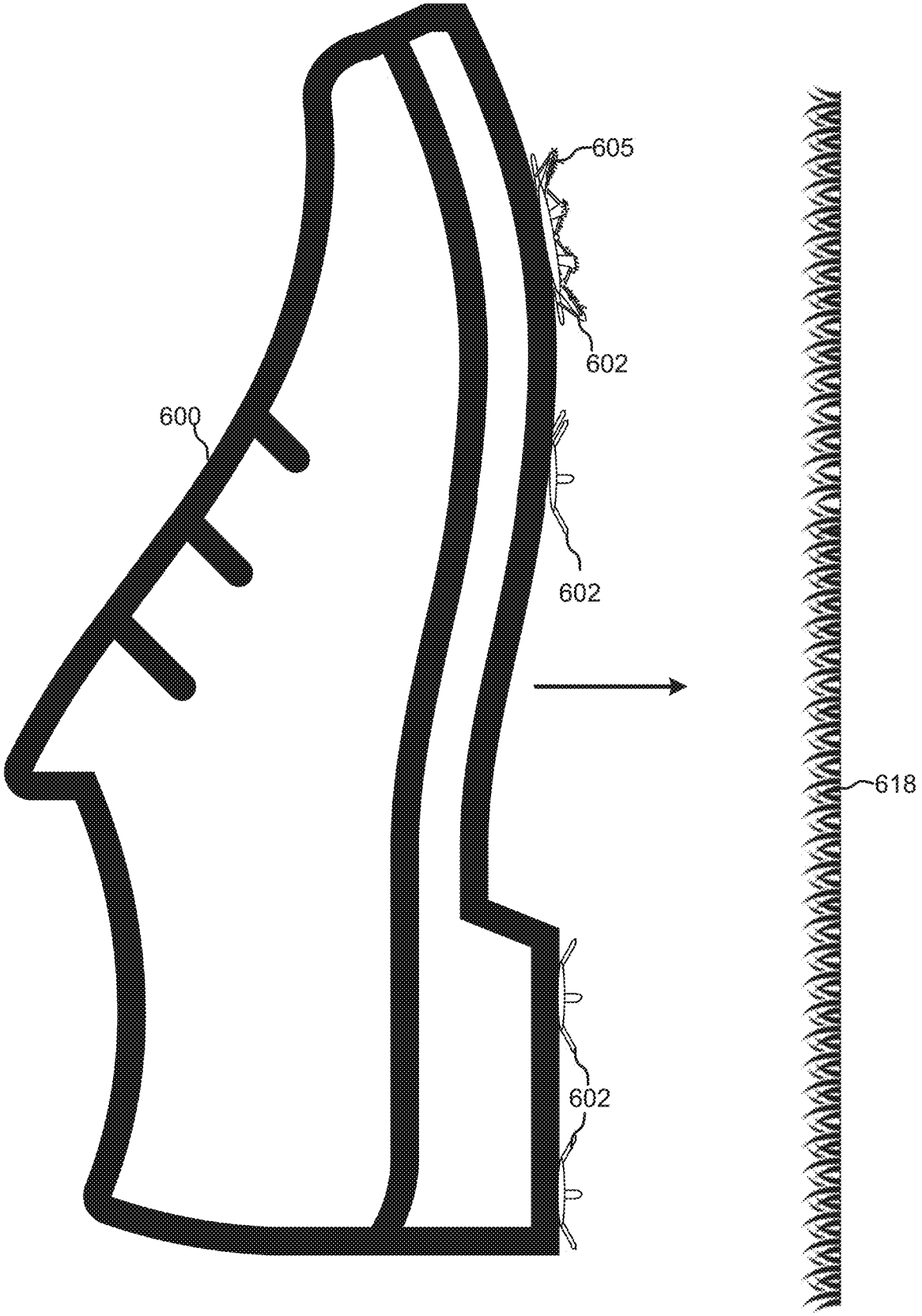

FIG. 6 illustrates an example use of a shoe 600 (e.g., FIGS. 4 and 5) including a plurality of cleats 602, at least one of which is a cleat with integrated bristles 605 (e.g., the cleat 100 of FIG. 1). The shoe 600 can be urged toward a ground surface 618, which could be short grass (e.g., a fairway, green, or tee box of a golf course), long grass (e.g., a rough of a of golf course), or sand (e.g., a bunker or tee box of a golf course). Thus, the ground surface 608 can be soft and/or slippery surface. The cleat with integrated bristles 605 can include a plurality of spike legs (e.g., plurality of spike legs 124 of FIG. 1) that provide traction to the shoe 600 when applied to the ground surface 708.

In some examples, the cleat with integrated bristles 605 can be in a second state (e.g., the second state of FIG. 3) in response to applying to the cleat with integrated bristles 605 to the ground surface 618, such as during walking when the soul of the shoe engages the ground. That is, bristle legs of the cleat with integrated bristles 605 are moved from a first state (e.g., the first state of FIG. 3) and away from the ground surface 618 to the second state. Accordingly, the bristle legs of the cleat with integrated bristles 605 are moved away from the ground so that the likelihood of picking up grass, dirt, or debris from the ground surface 618 is reduced. Rather, the spike legs of the cleat with integrated bristles 605 contact the ground surface 618, thereby providing traction to the shoe and moving from the first state to the second state. Again, because the bristle legs can be coupled to spike legs via a plurality of levers (e.g., the plurality of levers 140 of FIG. 1), pressure from the ground surface 618 that is applied to the spike legs causes the cleat with integrated bristles 605 to move from the first state to the second state (e.g., further away from the ground during walking).

Figure 7A:
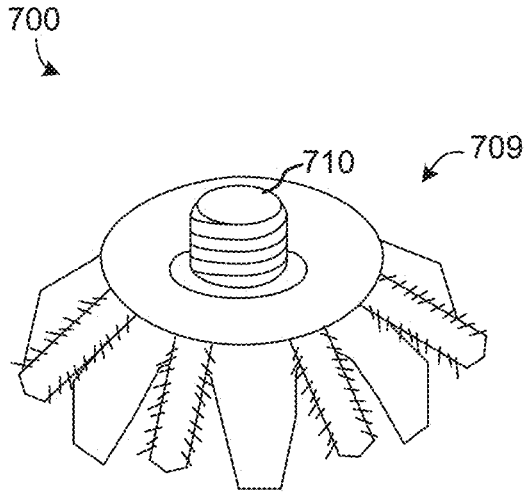
FIGS. 7A-C illustrate examples of fasteners of a cleat.
Figure 7B:
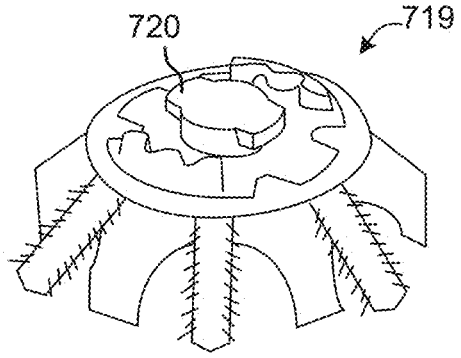
Figure 7C:
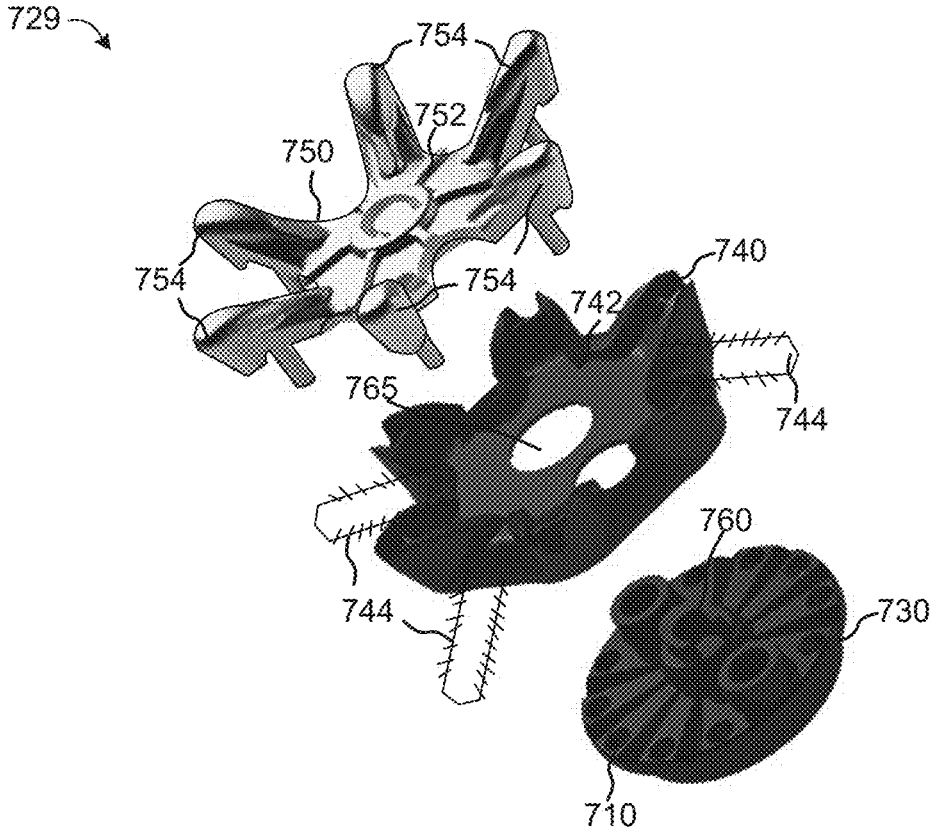

FIGS. 7A-C illustrate some examples of cleats with integrated bristles 700 and different types of fasteners. FIG. 7A illustrates a first cleat 709 (e.g., 100 of FIG. 1) can have a fastener 710 (e.g., 120 of FIG. 1) that is a threaded bolt. FIG. 7B illustrates a second cleat 719 (e.g., 100 of FIG. 1) that can have a fastener 720 (e.g., 120 of FIG. 1) in the form of a twist-lock mechanism. FIG. 7C illustrates a third cleat 729, shown in an assembly view, that can be modular, such that the cleat 729 includes a fastener module 730 (e.g., 120 of FIG. 1) having a first surface (not illustrated) opposing a second surface 732. The cleat 729 can include a support module 740, having a first surface opposing a second surface 742. The support module 740 can be integrated with a plurality of bristle legs 744 (e.g., bristle legs 106 of FIG. 1) that extend radially outward from the support module 740. The cleat 729 can further include a base module 750 (e.g., the base 110 of FIG. 1) having a first surface (e.g., the first surface 114 of FIG. 1) opposing a second surface 752 (e.g., the second surface 214 of FIG. 2A). The base module 750 can include a plurality of spike legs 754 (e.g., the plurality of spike legs 124 of FIG. 1) that extend radially outward from the second surface 752 of the base module 750. Further, the fastener module 730 is employed to couple to a sole of a shoe, as well as secure together the support module 740 between the base module 750 and the fastener module 730. That is, the first surface of the fastener module 730 can be a screw or lock mechanism configured to couple to the sole of a shoe. The second surface 732 of the fastener module 730 can have a connector 760 configured to couple to a connector of the first surface of the base 750.

The support module 740 of the third cleat 729 can also have hole 765 extending through the first surface to the second surface 742 of the support module 740. The hole 765 of the support module 740 can allow the connector 760 of the second surface 732 of the fastener module 730 to secure to the connector of the first side of the base module 750. Accordingly, the first surface of the base module 750 can be attached to the second surface 742 of the support module 740 and the first surface of the support module 740 can be attached to the second surface 732 of the fastener module 730. Because the connector 760 of the second surface 732 of the fastener module 730 can couple to the connector of the first side of the base module 750, the fastener module 730, the support module 740, and the base module 750 can be coupled together to form the third cleat 729 integrated with bristles. Additionally, different fastener modules 730, support (e.g., bristles) modules 740, and base (e.g., spike legs) modules 750 can be used interchangeably. Therefore, the support module 740 and/or base 750 can be coupled to the sole of a variety of shoes according to the configuration of the fastener module 730 or connector so of the shoe.

Figure 8A:
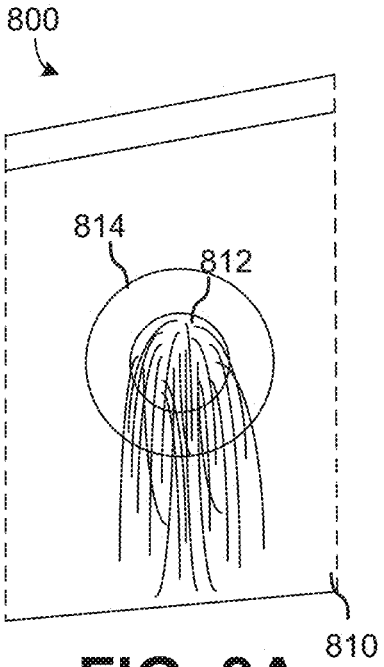
FIGS. 8A-C, 9 and 10 illustrates examples of bristle legs of a cleat with integrated bristles.
Figure 8B:
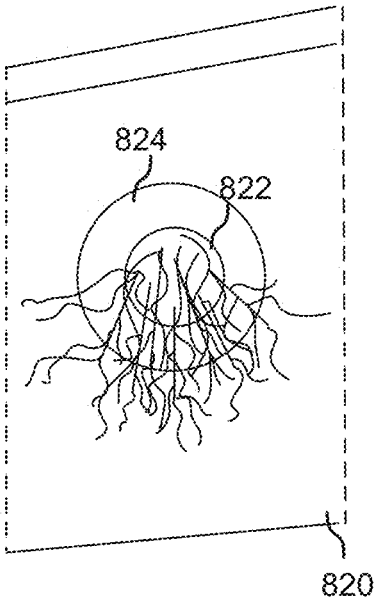
Figure 8C:
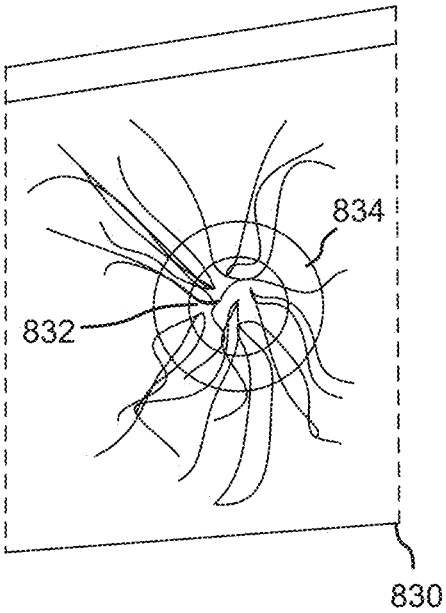

FIGS. 8A, 8B and 8C illustrate examples of different bristle legs 800 that can be integrated with a cleat, such as the cleat 100 of FIG. 1. A given bristle leg can have a plurality of bristles that are made of natural fibers (e.g., hair, hemp, etc.), metal (e.g., wire) natural or artificial elastomers, plastic polymers and the like, such as can typically be found in a golf club brush. In an example, the bristles can be bundled together and joined with a ferrule of the first bristled and plugged, and/or glued to the cleat, such as mounted across the surface of respective bristle legs, spike legs and/or base of the cleat.

As shown in FIG. 8A, a bristle leg 810 can have a bundle 812 of bristles joined within a ferrule 814. The bundle 812 of bristles can be formed from a rigid material, such as metal (e.g., copper). As shown in FIG. 8B, a bristle leg 820 can have a bundle 822 of bristles joined to a ferrule 824. The bundle 922 can be formed from a highly elastic material, such as hair. As shown in FIG. 8C, a bristle leg 830 can also have a bundle 832 of bristles that can be formed from an elastic material, such as a synthetic fiber, and joined to a ferrule 834. That is, the bundle 832 of bristles can be formed from a material that is more elastic than the first bundle 812 of bristles of FIG. 8A and less elastic than the bundle 822 of bristles of FIG. 8B. Moreover, a given bristle leg can have bundles of bristles that are formed of a uniform material.

Figure 9:
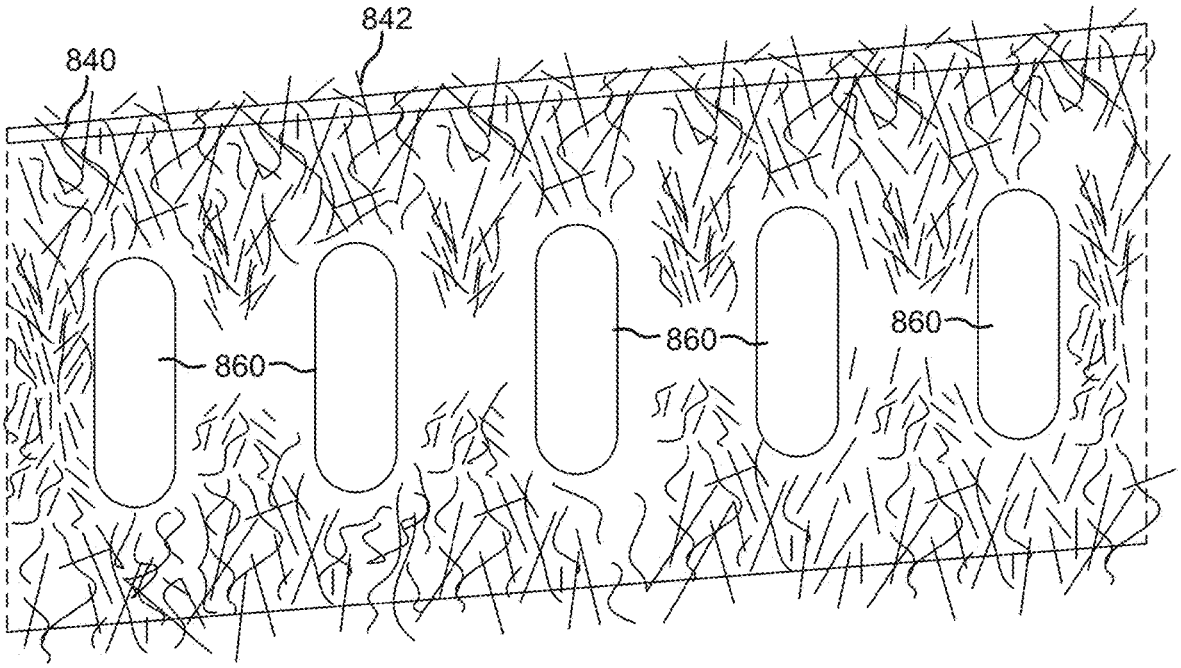

FIG. 9 depicts an example of a bristle leg 940 having a plurality of bristles 942 formed, or plugged and glued, across the bristle leg. The bristles 842 can be formed from an elastic material (e.g., synthetic fiber) or a highly elastic material (e.g., hair). The bristle leg can also have a plurality of protrusions 960 across the second bristle leg 940. The protrusions 960 can be formed of a material that is more rigid than the bristles, such as rubber, a synthetic fiber or polymer. Additionally, the protrusions 960 have a length that is shorter than the plurality of bristles. Accordingly, when the second bristle leg 940 is applied to a surface, the bristles 942 of the second bristle leg 940 may bend away from the surface. However, the protrusions 960 are formed such that the protrusions 960 prevent the surface from directly contacting the bristle leg and prevent overuse of the bristles 942 of the second bristle leg 940.

Figure 10:
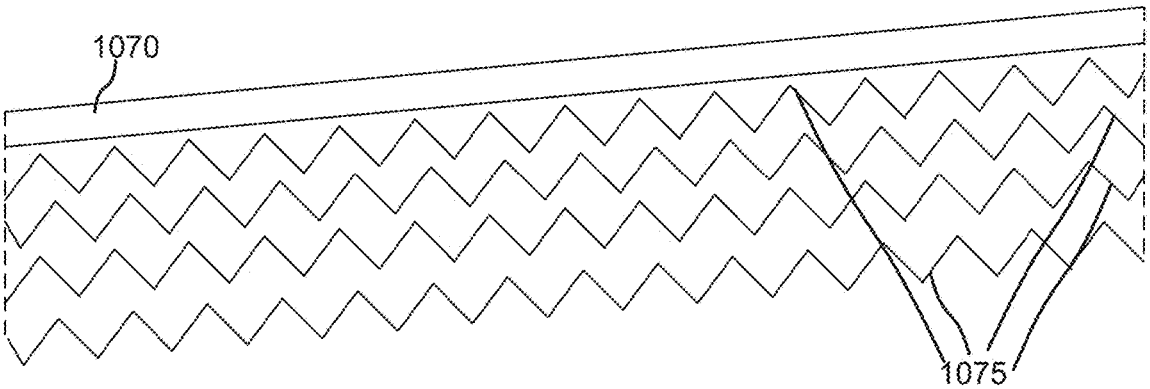

FIG. 10 depicts part of another example bristle leg 1070 having a plurality of protrusions 870 that form a texture on a surface of the third bristle leg 1070. The protrusions 1070 can be of different lengths and be formed from an elastic material. In some examples, the protrusions can be pointed so as to facilitate cleaning the face of a golf club, including club head grooves. For example the protrusions have a triangular prism or conical shape; though other shapes can be used in other examples. Moreover, the protrusions 1075 of the bristle leg 1070 can also be integrated into spike legs (e.g., the plurality of spike legs 124 of FIG. 1). The protrusions 1070 themselves thus can be implemented as bristles configured to clean the face of a golf club (e.g., FIG. 5), such as described herein. In some examples, additional bristles (e.g., bristles 812, 822 and/or 832) can extend from the bristle legs 1070 (and/or spike legs) at locations between respective protrusions 1075. In this way, the protrusions 1070 can help protect the bristles by operating as a stop mechanism to prevent the ground (or another object) from crushing or bending the bristles past the distal end of the protrusions 1070.

Figure 11:
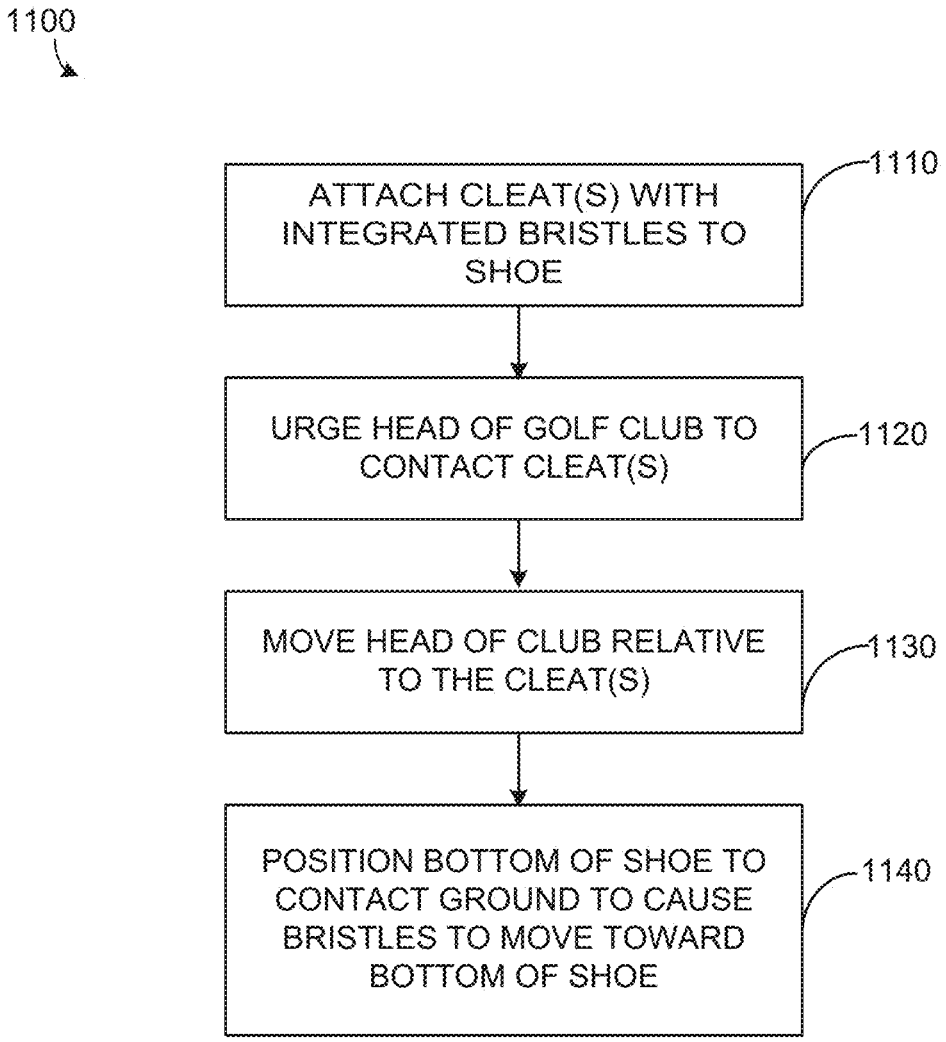
FIG. 11 illustrates a flowchart of an example method for cleaning a golf club using a cleat with integrated bristles.

FIG. 11 illustrates a flowchart 1100 of an example method for cleaning a face of a golf club using a golf cleat integrated with bristles and coupled to a shoe. At 1110, a cleat with integrated bristles, such as the cleat 100 of FIG. 1 or any other figure shown herein (e.g., FIGS. 2-7, 12 and 13-15) can be attached to the sole of a shoe (see, e.g., FIGS. 5 and 6). At 1120, the cleat with integrated bristles can be urged toward the face of a golf club (e.g., FIG. 5), or the golf club can be urged toward the cleat with integrated bristles. Accordingly, the cleat with integrated bristles can be used to clean the face of a golf club, such as the golf club 512 of FIG. 5. At 1130, the head of the club can be moved relative to the cleat with integrated bristles, such that dirt and debris can be removed from grooves in the face of the golf club (e.g., grooves 515 of FIG. 5). At 1140, the bottom of the shoe (e.g., shoe 600 of FIG. 6) can be positioned to contact the ground (e.g., ground surface 618), which causes the bristles integrated with the cleat to move towards the bottom of the shoe. In other words, moving the club relative to the cleats at 1130 can employ the cleat with integrated bristles in a first state of FIG. 3 (see also FIG. 13), and contacting the ground at 1140 causes the cleat with integrated bristles to move to the second state of FIG. 3 (see also FIG. 14).

Figure 12:
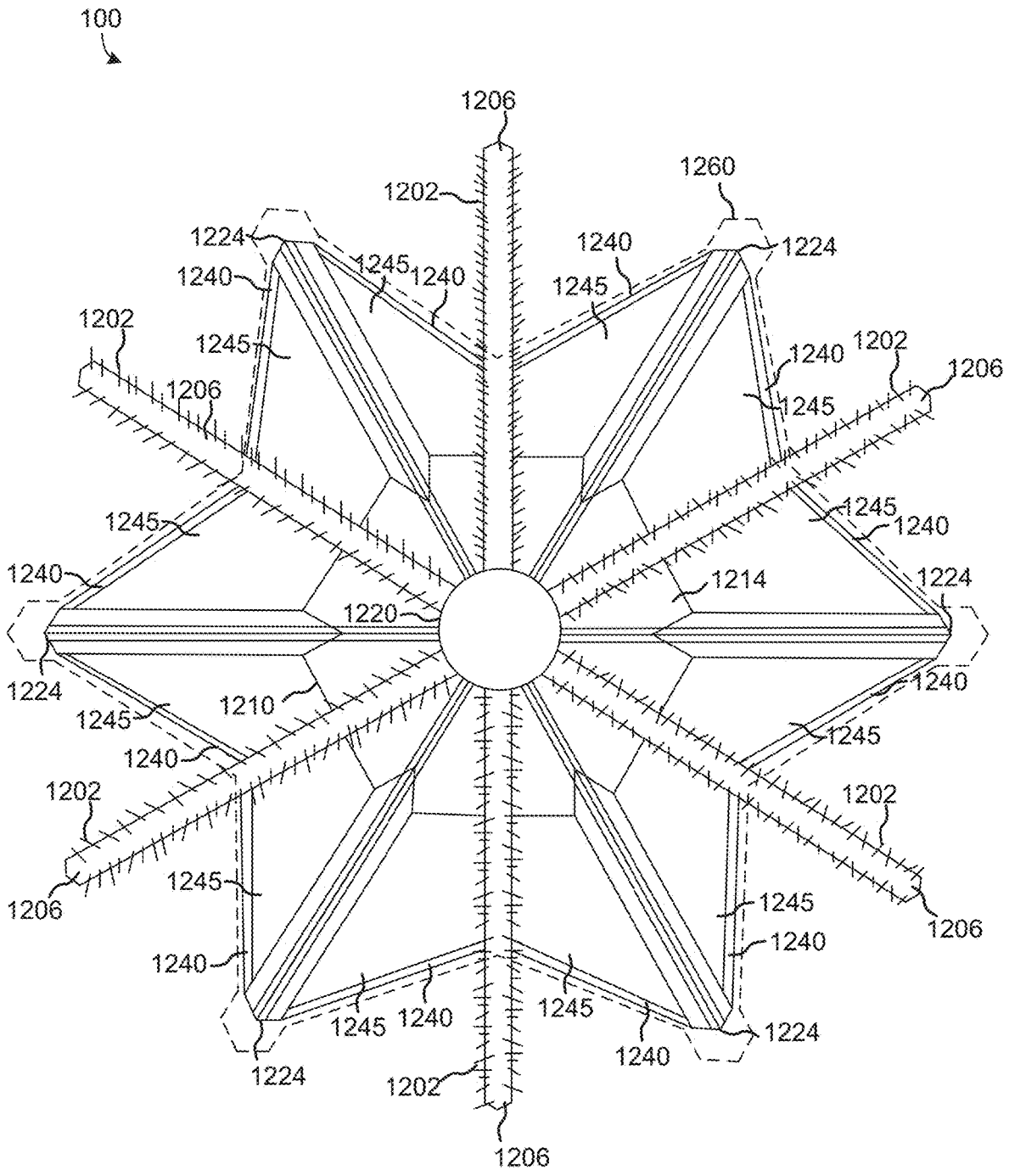
FIG. 12 illustrates formation of another example cleat with integrated bristles.

FIG. 12 illustrates an example cleat 1200 integrated with a plurality of bristles 1202. The cleat 1200 can include a plurality of bristle legs 1206 that are coupled to a support frame 1210. The support frame 1210 can have a first surface 1214 opposing a second surface. The support frame can include a central hub portion 1220, such that a proximal portion of the bristle legs 1206 are coupled to the central hub portion 1220. Additionally, the support frame 1210 can include a plurality of core legs 1224 extending radially outwardly from the central hub 1220. In an example, the core legs 1224 are extensions of the support frame 1210. The support frame 1210 and core legs 1224 can be constructed from a plastic or an elastomer. In some examples, the support frame 1220 can be formed by additive manufacturing or a stamp press. The plurality of core legs 1224 can be alternately arranged with the bristle legs 1206 around the central hub portions 1220.

The support frame 1210 can further include a plurality of struts 1240 (e.g., corresponding to lever described herein) that extend between adjacent core legs 1224. For example, the struts 1240 can extend from a respective core leg 1224 and be adapted to couple to a bristle leg 1206. In some examples, a strut 1240 can couple to a distal end of a core leg 1224 and a medial portion of an adjacent bristle leg 1206. Accordingly, the plurality of struts 1240 can form a web between the plurality of core legs 1224 and plurality of bristle legs 1206. Therefore, an opening can form between a corresponding strut 1240, bristle leg 1206, core leg 1224, and the support frame 1210.

Additionally, the support frame 1210 can be integrated with a flexible material 1260, as illustrated with a dashed line. For example, the support frame 1210 can be coated (or layered) by the flexible material 1260 via a dip molding or dip coating process. Alternatively, the flexible material 1260 can be applied over the support frame 1210 via an injection mold. The flexible material 1260 can be a layer of flexible material 1260 over at least the core legs 1224 and struts 1240 of the support frame 1210 to form spike legs (e.g., spike legs 124 of FIG. 1) and a proximal portion of the bristle legs (e.g., bristle legs 106 of FIG. 1). The bristles 1202 extending outwardly from at least a distal end portion of the bristle legs 1206 can be free of the flexible material 1260. Alternatively, the bristle legs 1206 can be substantially free of the flexible material 1260. In other examples, the flexible material 1260 and support frame 1210 can be formed together via additive manufacturing (e.g., 3D printing), a stamp press or other methods, which can vary depending on the materials being used to form the cleats.

Figure 13:
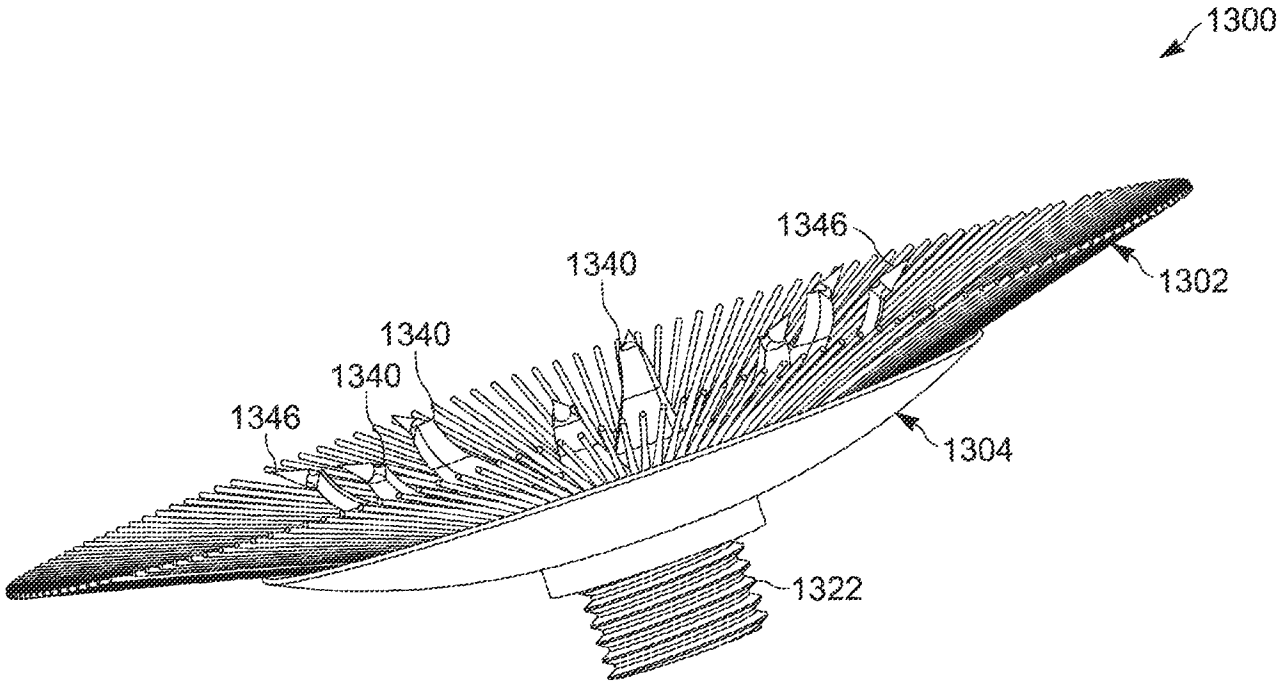
FIG. 13 illustrates another example cleat with integrated bristles.
Figure 14:
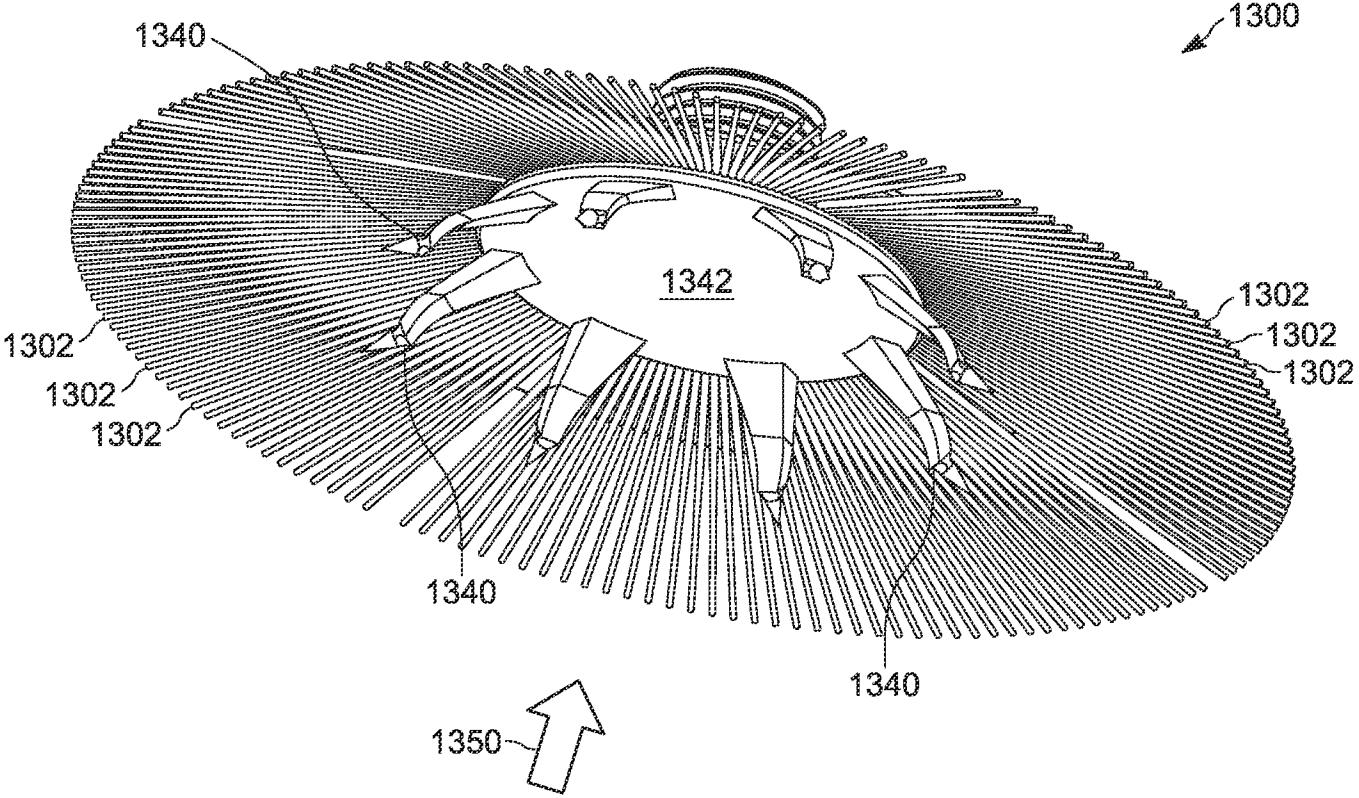
FIG. 14 illustrates the example cleat of FIG. 13 in a compressed condition.
Figure 15:
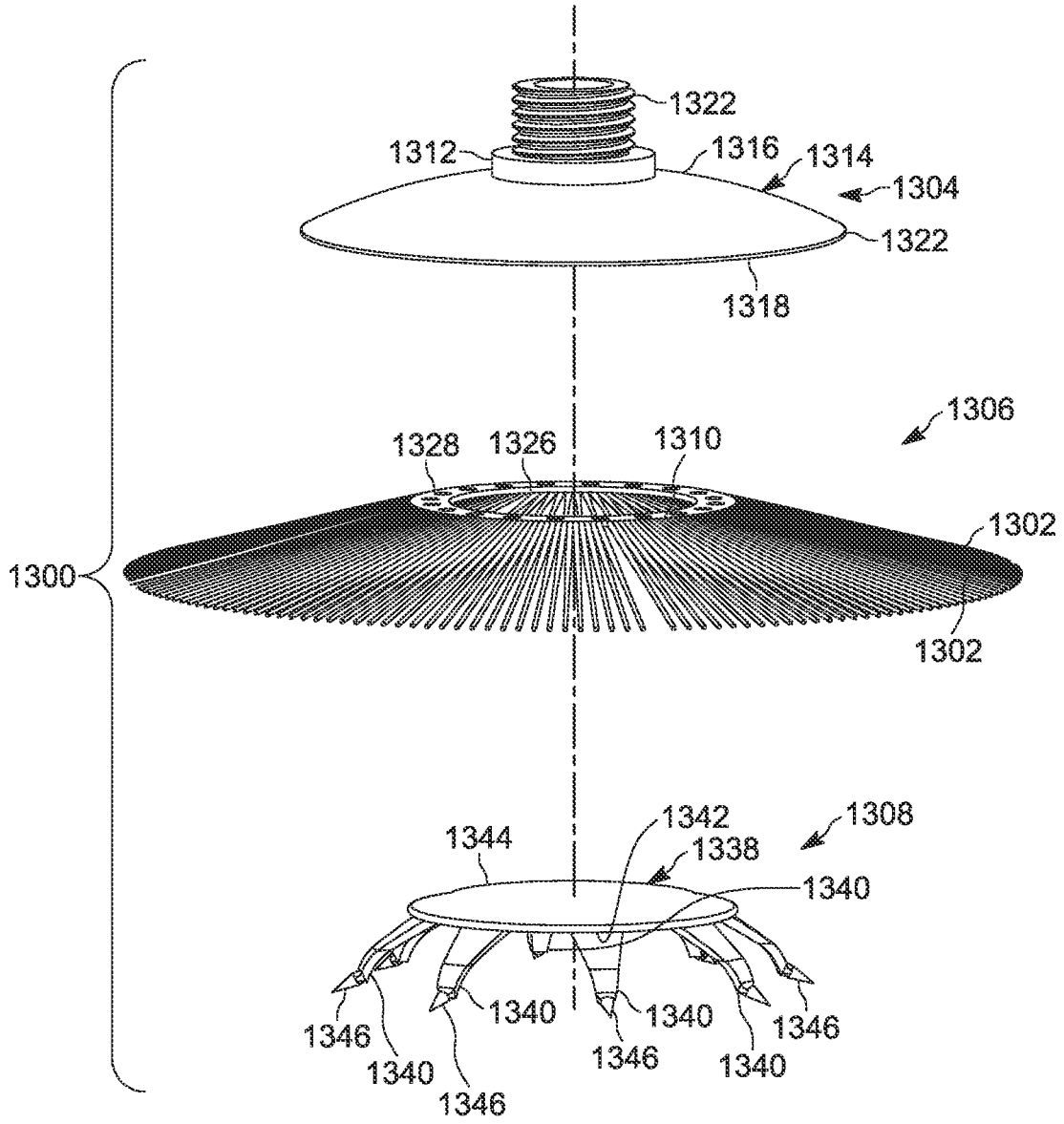
FIG. 15 is an assembly view of the example cleat of FIG. 13.

FIGS. 13-15 illustrate another example of a cleat 1300 having integrated bristles 1302. The cleat 1300 includes three main components, shown in FIG. 15 as a fastener part 1304, a bristle part 1306 and a leg part 1308, which can be combined to form the cleat described herein (see, e.g., FIGS. 13-14 as well as other example embodiments, including FIGS. 1-7 and 12). For example, the bristle part 1306 is sandwiched between the fastener part 1304 and the leg part 1308. In one example, the bristle part 1306 is a metal part and the fastener and leg parts 1304 and 1308 are plastic (e.g., same or different plastic materials), which can be injection molded around a central support portion 1310 of the bristle part 1306. In another example, the respective parts 1304, 1306 and 1308 can each be formed separately and assembled together to form the cleat 1300.

As shown in FIGS. 13-15, the fastener part 1304 includes a central portion 1312 and a base member 1314 of a flexible material (e.g., an elastically deformable plastic) that extends outwardly from the central portion. In the example of FIGS. 13-15, the base member 1314 is curved web of flexible materially that has axially opposed proximal and distal surfaces 1316 and 1318 and a periphery 1320. The distal surface 1318 of the base member 1314 can be concave (e.g., base member can be cup- or bowl-shaped). A fastener 1322, which can be attached to and/or integrated with the fastener part, extends axially from a proximal side of the central portion 1312. The fastener 1322 can be a threaded fastener (as shown), pins, twist-lock fasteners or other type of cleat insert system. The fastener 1322 can be a rigid material that is held by the elastic material that forms the support portion 1310. For example, the fastener 1322 can be integrated into the fastener part 1304, such as during injection molding or another fabrication technique).

The bristle part 1306 includes the central support portion 1310 and the bristles 1302 extending outwardly from the central support portion. In an example, the central support portion 1310 is an annular support (e.g., a ring) having inner and outer peripheries 1326 and 1328, respectively. Alternatively, the support portion 1310 can include a plurality of separate support pieces (e.g., pie-shaped wedges or sectors), in which each support piece includes a respective set of bristles extending therefrom. The outer periphery 1328 of the central support (whether a ring or sheet, such as a disc or multiple support pieces) can have an outer diameter that approximates or is less than the outer diameter of the base member 1314 of the fastener part 1304.

For example, the bristles 1302 extend radially and axially from the outer periphery 1328 in a distal direction, such as shown in FIG. 13. Thus, when the cleat 1300 is mounted to a shoe, the bristles 1302 extend away from the shoe. In an example, the central support portion 1310 and bristles 1302 are formed as a monolithic structure from one or more sheets of material (e.g., metal), such as by stamping, etching and/or cutting. The bristles 1302 can extend the same length or have different lengths. Also, or alternatively, the bristles 1302 can have the same or different widths and/or shapes to facilitate their cleaning function.

Figure 16:
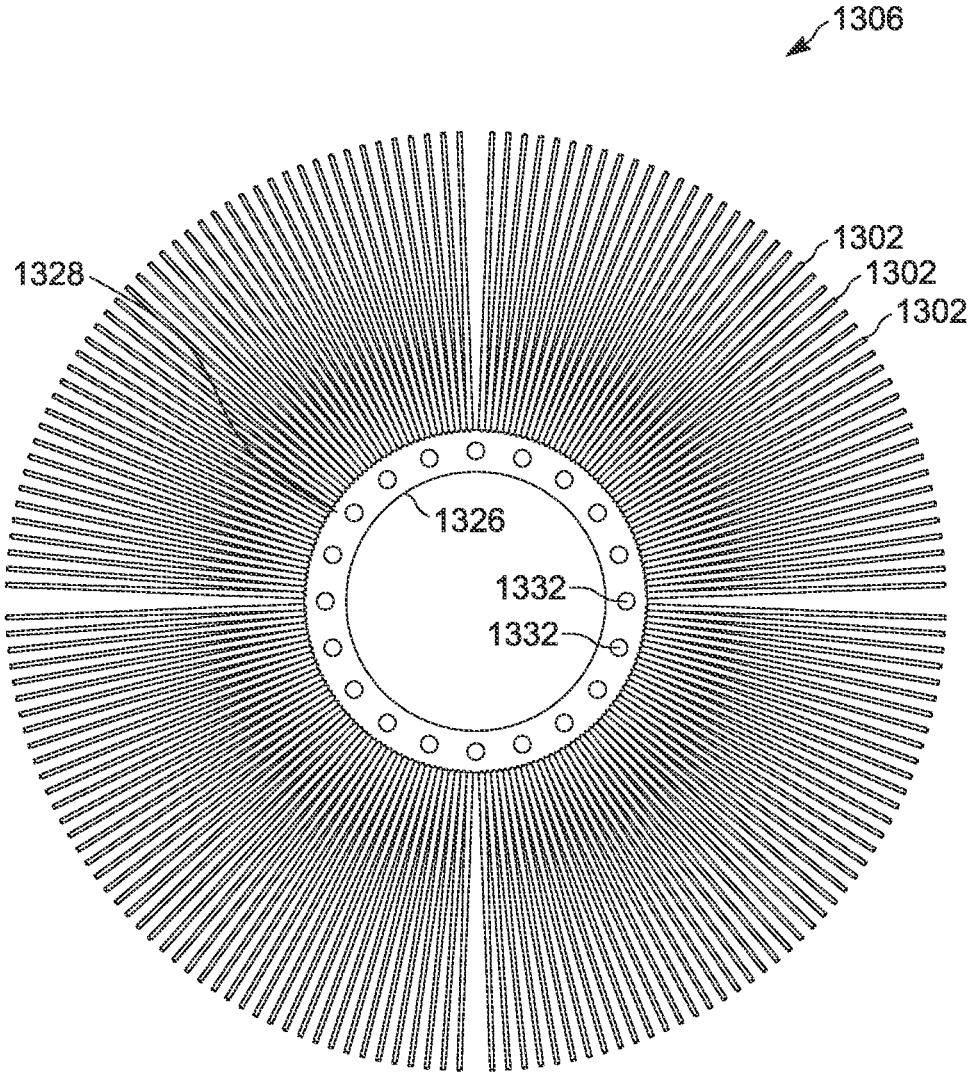
FIG. 16 is a plan view of an example bristle part for a cleat.

In an example, such as shown in FIG. 16, the central support portion 1310 includes a plurality of apertures 1332 extending therethrough, which can be configured to enable material from the fastener part 1304 and/or the leg part 1308 to insert into or through the apertures (e.g., during manufacture). For example, plastic material of the fastener part 1304 and/or the leg part 1308 can be heated sufficiently to enable the plastic to melt (partially or wholly) and flow into the apertures, which when cooled holds the cleat together as an integrated structure. In other examples, the bristle part 1306 (or just the central support portion 1310 thereof) can be formed of a plastic material to facilitate bonding with the fastener and leg parts 1304 and 1308. In still other examples, all the parts can be integrated together during an injection molding or other fabrication process such as to form a monolithic cleat structure.

The leg part 1308 includes base member 1338 and a plurality of spike legs 1340 that are arranged to extend outwardly from a distal side 1342 of the base member 1338. While the base member 1338 is shown as separate from the fastener part 1304 and bristle part 1306, in other examples, the base member 1338 can be integrated with the central portion 1310 of the bristle part 1306 (e.g., integrated with the central support portion 1310 thereof) and/or with the fastener part 1304 (e.g., integrated with the central portion 1312 and/or base member 1314). In the example of FIG. 15, a proximal surface 1344 of the base member 1338 can have a size and shape (e.g., a concave surface) adapted to fit against the distal surface (e.g., a convex surface) 1318 of the fastener part 1304. Other shapes for the respective surfaces can be used to enable formation of the cleat 1300, such as described herein. That is, as mentioned, the three-part design of FIGS. 13-15 shows one example approach that can be used to make the cleat 1300.

The spike legs 1340 can be evenly distributed across the distal side 1342 and/or include any desired number and arrangement of spike legs. Also, or alternatively, the spike legs 1340 can be formed to have one or more different shapes and sizes, which when attached to the shoe are particularly adapted to increase traction and/or gripping of the ground. In the example of FIGS. 13-15, each of the spike legs extends axially from the central base member 1338 to terminate in a distal end portion 1346. The spike legs 1340 can include a first portion extending from the base member axially in a first direction and a second portion extending further axially at an angle relative to the first portion. Also, or alternatively, the spike legs 1340 can be curved and/or have any number of portions depending on the spike design. The distal end portion 1346 can itself extend axially or laterally (e.g., orthogonal to the axis) or extend at an angle between laterally and axially from the spike leg 1340. In an example, the distal end portion 1346 of some or all spike legs 1340 of the cleat 1300 can be pointed, such as having a conical or other pointed spike feature. The conical spike features at 1346 thus can be used to help clean the face of golf clubs, such as by inserting into grooves of the clubs, as described herein.

FIGS. 13 and 14 show the cleat 1300 in two different conditions. In FIG. 13, the cleat 1300 is shown in a normal condition (e.g., at rest), in which the bristles and spike legs 1340 extend axially away from the proximal end and fastener. As shown, the spike legs 1340 extend from the base member 1338 so at least the distal end portion 1346 thereof extends beyond the distal extent of the bristles (or at least a portion of the bristles). For example, the curved shape of the base portion(s) 1314, 1338 (concave distal surface) is thus adapted to mechanically bias the spike legs 1340 and bristles 1302 axially in a distal direction away from the fastener 1322 and the sole of the shoe to which the cleat is mounted. In response to an axial force, shown at arrow 1350, being applied to one or more spike legs 1340 (e.g., in a direction towards the base member 1338), at least a portion of the force causes corresponding axial movement of the base member 1338, which further moves the central support 1310 and the associated bristles 1302 axially in the same direction as the arrow 1350, such as shown at 1300' in FIG. 14. When the cleat 1300 is attached to the shoe, the bristles 1302 thus will move towards the sole of the shoe and, in some cases, might contact the sole of the shoe in response to force applied to the spike legs 1340. When the force is no longer applied to the spike legs 1340, the respective parts of the cleat are adapted (e.g., elastically deformable) to return to their normal (e.g., rest) condition, such as shown in FIG. 13.

As used herein, the terms "comprises" and/or "comprising," as used herein, can specify the presence of stated features, steps, operations, elements, and/or components, but do not preclude the presence or addition of one or more other features, steps, operations, elements, components, and/or groups thereof. Also, as used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

As used herein, phrases and/or drawing labels such as "X-Y", "between X and Y" and "between about X and Y" can be interpreted to include X and Y.

Unless otherwise specified, it will be understood that when an element is referred to as being "on," "attached" to, "connected" to, "coupled" with, "contacting", "adjacent", etc., another element, it can be directly on, attached to, connected to, coupled with, contacting, or adjacent the other element or intervening elements may also be present. In contrast, when an element is referred to as being, for example, "directly on," "directly attached" to, "directly connected" to, "directly coupled" with, "directly contacting", or "directly adjacent" another element, there are no intervening elements present. It will also be appreciated by those of skill in the art that references to a structure or feature that is disposed "directly adjacent" another feature may have portions that overlap or underlie the adjacent feature, whereas a structure or feature that is disposed "adjacent" another feature might not have portions that overlap or underlie the adjacent feature.

Spatially relative terms, such as "under," "below," "lower," "over," "upper", "proximal", "distal", and the like, may be used herein for ease of description to describe one element or feature's relationship to another element(s) or feature(s) as illustrated in the figures. It will be understood that the spatially relative terms can encompass different orientations of a device in use or operation, in addition to the orientation depicted in the figures. For example, if a device in the figures is inverted, elements described as "under" or "beneath" other elements or features would then be oriented "over" the other elements or features.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present disclosure. The sequence of operations (or steps) is not limited to the order presented in the claims or figures unless specifically indicated otherwise.

While aspects of this disclosure have been particularly shown and described with reference to the example aspects above, it will be understood by those of ordinary skill in the art that various additional aspects may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. In an effort to maintain clarity in the Figures, certain ones of duplicative components shown have not been specifically numbered, but one of ordinary skill in the art will realize, based upon the components that were numbered, the element numbers which should be associated with the unnumbered components; no differentiation between similar components is intended or implied solely by the presence or absence of an element number in the Figures. Any of the described structures and components could be integrally formed as a single unitary or monolithic piece or made up of separate sub-components, with either of these formations involving any suitable stock or bespoke components and/or any suitable material or combinations of materials; however, the chosen material(s) should be biocompatible for many applications. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

What have been described above are examples. It is, of course, not possible to describe every conceivable combination of components or methodologies, but one of ordinary skill in the art will recognize that many further combinations and permutations are possible. Accordingly, the invention is intended to embrace all such alterations, modifications, and variations that fall within the scope of this application, including the appended claims.

What is claimed is:

1. A cleat for a shoe, the cleat comprising:

a base having opposing first and second surfaces;

a fastener extending from the first surface and adapted to couple the cleat to a sole of the shoe;

a plurality of spike legs arranged in a distributed arrangement and extending outwardly from the second surface of the base to terminate in a distal end portion spaced from the second surface, wherein each spike leg of the plurality of spike legs includes a proximal elongate portion that extends radially outwardly from a central portion of the base, the distal end portion extending from the proximal elongate portion, and at least a terminal end portion of the distal end portion curving in a direction away from the second surface and adapted to contact ground; and bristles extending outwardly from the second surface of the base, wherein the base from which the bristles extend has a curved shape configured to mechanically bias the spike legs and bristles away from the second surface of the base, and wherein responsive to applying an axial force to a given spike leg of the plurality of spike legs in a direction towards the second surface of the base at least some of the force is transferred to cause corresponding movement of some of the bristles adjacent the given spike leg towards the second surface of the base.

2. The cleat of claim 1, wherein the bristles are coupled to and extend outwardly from at least some of the spike legs in a direction away from the second surface.

3. The cleat of claim 1, wherein the bristles further comprise:

a plurality of bristle legs extending outwardly from the second surface of the base to terminate in a distal end portion spaced from the second surface, respective bristle legs located between at least some adjacent pairs of the spike legs, a multitude of bristles extending outwardly from at least the distal end portion of the bristle legs.

4. The cleat of claim 3, further comprising a web interconnecting each respective bristle leg between an adjacent pair of the spike legs, wherein the bristle legs have a radially outward extent extending from the base a distance that is longer than a length of the spike legs, such that movement of spike legs toward the second surface is transmitted through the web to move respective bristle legs commensurate with the movement of the spike legs and a distal-most end of the bristle legs is spaced closer to the second surface than a distal-most end of the spike legs.

5. The cleat of claim 1, wherein the plurality of spike legs comprises an elastic material.

6. The cleat of claim 1, wherein the bristles comprise a natural polymer material, synthetic polymer material and/or a metal material.

7. The cleat of claim 1, wherein the distal end portion of at least some of the spike legs tapers from a first cross-sectional width along a proximal portion of the spike legs to terminate in a pointed distal end.

8. The cleat of claim 1, wherein the bristles have a different amount of stiffness than the plurality of legs.

9. A cleat for a shoe, the cleat comprising:

a base having opposing first and second surfaces;

a fastener extending from the first surface and adapted to couple the cleat to a sole of the shoe;

a plurality of spike legs arranged in a distributed arrangement and extending outwardly from the second surface of the base to terminate in a distal end portion spaced from the second surface; and bristles extending outwardly from the second surface of the base, wherein the base from which the bristles extend has a curved shape configured to mechanically bias the spike legs and bristles away from the second surface of the base, wherein the base comprises:

a fastener base member from which the fastener extends proximally; and a leg base member from which the spike legs extend distally, and wherein the bristles extend from a central support member that is sandwiched, at least partially, between a distal surface of the fastener base member and a proximal surface of the leg base member, and wherein responsive to applying an axial force to a given spike leg of the plurality of spike legs in a direction towards the second surface of the base at least some of the force is transferred to cause corresponding movement of some of the bristles adjacent the given spike leg towards the second surface of the base.

10. The cleat of claim 9, wherein the central support member comprises an annular support, in which the annular support is coupled to at least one of the distal surface of the fastener base member and the proximal surface of the leg base member, such that axial movement of the annular support causes corresponding movement of the bristles.

11. A cleat for a shoe, the cleat comprising:

a base having opposing first and second surfaces;

a fastener extending from the first surface and adapted to couple the cleat to a sole of a shoe;

a plurality of spike legs extending radially outwardly and axially from the second surface of the base; and a plurality of bristles extending radially outwardly from the base, wherein each of the spike legs has a cross-sectional width and extends an axial length away from the base, and each of the bristles has a cross-sectional width and extends an axial length away from the base, and wherein the cross-sectional width and the axial length of the spike legs are greater than the cross-sectional width and the axial length of the bristles, wherein the bristles extend from a central support member, in which the central support member has a proximal surface that engages and is coupled to a distal surface of the base, the base is adapted to move axially in response to axial force being applied to one or more spike legs of the plurality of spike legs, and the bristles are adapted to move axially in response to axial movement of the base.

12. The cleat of claim 11, wherein the plurality of bristles and plurality of spike legs are alternately arranged and extending radially outwardly from the base.

13. The cleat of claim 12, further comprising:

a plurality of levers, wherein each lever is coupled to an arrangement of the bristles located between a respective pair of adjacent spike legs.

14. The cleat of claim 11, wherein the bristles further comprise:

a plurality of bristle legs extending outwardly from the second surface of the base to terminate in a distal end portion spaced from the second surface, respective bristle legs located between at least some adjacent pairs of the spike legs, a multitude of bristles extending outwardly from at least the distal end portion of the bristle legs.

15. The cleat of claim 14, further comprising a web interconnecting each respective bristle leg between an adjacent pair of the spike legs, wherein the bristle legs have a radially outward extent extending from the base a distance that is longer than a length of the spike legs, such that movement of spike legs toward the second surface is transmitted through the web to move respective bristle legs commensurate with the movement of the spike legs and a distal-most end of the bristle legs is spaced closer to the second surface than a distal-most end of the spike legs.

* * * * *